US011562694B2

(12) United States Patent
Koshihara et al.

(10) Patent No.: US 11,562,694 B2
(45) Date of Patent: Jan. 24, 2023

(54) DISPLAY DEVICE AND ELECTRONIC DEVICE HAVING SELECTORS CONFIGURED TO SELECT LIGHT EMITTING ELEMENTS ARRANGED IN A MATRIX

(71) Applicant: SEIKO EPSON CORPORATION, Tokyo (JP)

(72) Inventors: Takeshi Koshihara, Matsumoto (JP); Hitoshi Ota, Shiojiri (JP); Takumi Kodama, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/489,111

(22) Filed: Sep. 29, 2021

(65) Prior Publication Data

US 2022/0101791 A1 Mar. 31, 2022

(30) Foreign Application Priority Data

Sep. 30, 2020 (JP) ..... JP2020-165798

(51) Int. Cl.
*G09G 3/3233* (2016.01)

(52) U.S. Cl.
CPC ... *G09G 3/3233* (2013.01); *G09G 2300/0842* (2013.01); *G09G 2310/08* (2013.01); *G09G 2320/0233* (2013.01)

(58) Field of Classification Search
CPC ..... G09G 3/3233; G09G 2300/0842; G09G 2310/08; G09G 2320/0233
See application file for complete search history.

(56) References Cited

U.S. PATENT DOCUMENTS

| | | | | |
|---|---|---|---|---|
| 8,188,947 | B2 * | 5/2012 | Chung | G09G 3/3233 345/82 |
| 2005/0116656 | A1 * | 6/2005 | Shin | G09G 3/3233 315/169.3 |
| 2006/0044245 | A1 | 3/2006 | Park et al. | |
| 2007/0013797 | A1 * | 1/2007 | McKee | H04N 5/3559 348/E3.018 |
| 2007/0085779 | A1 | 4/2007 | Smith et al. | |
| 2010/0259511 | A1 | 10/2010 | Kimura et al. | |

FOREIGN PATENT DOCUMENTS

| | | |
|---|---|---|
| JP | 2006-065274 A | 3/2006 |
| JP | 2008-515016 A | 5/2008 |
| WO | 2008/099936 A1 | 8/2008 |

* cited by examiner

*Primary Examiner* — Stephen G Sherman
(74) *Attorney, Agent, or Firm* — Oliff PLC

(57) ABSTRACT

A pixel circuit 16(*n*) and a pixel circuit 16(*n*−1) acquire a data signal from a data line 14. A selector 30(*n*) supplies the data signal acquired from the pixel circuit 16(*n*) to a light emitting element selected from the light emitting elements 18(*n*−1), 18(*n*), and 18(*n*+1). A selector 30(*n*−1) can select at least the light emitting element 18(*n*−1), and supplies the data signal acquired from the pixel circuit 16(*n*−1) to the selected destination. In a sub-frame B, the selector 30(*n*) selects the light emitting elements 18(*n*) and 18(*n*+1), and the selector 30(*n*−1) selects the light emitting element 18(*n*−1). In a sub-frame A, the selector 30(*n*) selects the light emitting elements 18(*n*−1) and 18(*n*).

12 Claims, 23 Drawing Sheets

DISPLAY DEVICE AND ELECTRONIC DEVICE HAVING SELECTORS CONFIGURED TO SELECT LIGHT EMITTING ELEMENTS ARRANGED IN A MATRIX

The present application is based on, and claims priority from JP Application Serial Number 2020-165798, filed on Sep. 30, 2020, the disclosure of which is hereby incorporated by reference herein in its entirety.

BACKGROUND

1. Technical Field

The present disclosure relates to a display device and an electronic device.

2. Related Art

There is a display device having a display panel in which a plurality of light emitting elements are arrayed in a matrix manner. For such a device, a configuration is proposed, in which a pixel circuit acquires a data signal from a data line and outputs the acquired data signal to a light emitting element to emit light; and the pixel circuit is coupled to a plurality of light emitting elements. For example, JP-A-2006-65274 discloses a display device in which a plurality of light emitting elements are coupled to one pixel circuit, and one light emitting element of the plurality of light emitting elements is caused to emit light for each sub-frame. With the display device disclosed in JP-A-2006-65274, it is possible to reduce the number of wiring lines or the like formed on the display panel, which makes it possible to improve the aperture ratio of the display device.

In order to achieve a display panel having higher definition without increasing the number of drive transistors, it can be considered to employ a method of coupling a plurality of light emitting elements to one pixel circuit as in JP-A-2006-65274, and causing each of the light emitting elements to emit light in a time division manner. However, this method switches, for every sub-frame, light emitting elements coupled to the pixel circuit, and hence, cannot make the electric current continuously flow in the light emitting elements throughout one frame. Thus, this method is disadvantageously not suitable to increase the luminance.

SUMMARY

In order to solve the problem described above, one aspect of a display device according to the present disclosure includes a data line, a first pixel circuit provided corresponding to the data line, a second pixel circuit provided corresponding to the data line, first to ninth light emitting elements arrayed in a matrix manner with the first light emitting element being a center, a first selector configured to select at least any of the first light emitting element, the second light emitting element, and the third light emitting element, and supply the selected light emitting element by the first selector with a current corresponding to a potential supplied to the first pixel circuit, and a second selector that is capable of selecting at least the second light emitting element and is configured supply the selected light emitting element by the second selector with a current corresponding to a potential supplied to the second pixel circuit, in which, in one sub-frame, the first selector selects the first light emitting element and the third light emitting element, and the second selector selects the second light emitting element, and in a sub-frame differing from the one sub-frame, the first selector selects the first light emitting element and the second light emitting element.

DESCRIPTION OF EXEMPLARY EMBODIMENTS

Below, a display device according to embodiment of the present disclosure will be described with reference to the drawings. Note that, in each of the drawings, the dimensions and scale of each portion is set so as to appropriately differ from the actual dimension or scale of each corresponding portion. In addition, the embodiment described below is a preferred specific example. Thus, various types of technically preferred limitations are applied. However, the scope of the present disclosure is not limited to these modes unless, in the following description, there is description that particularly limits the present disclosure.

1. First Embodiment

Figure 1:
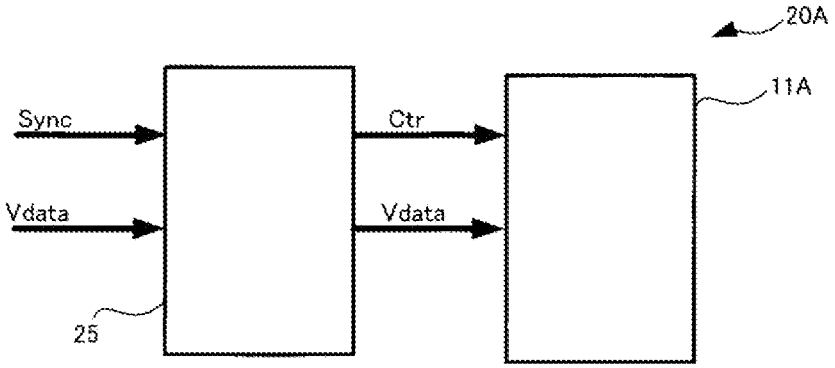
FIG. 1 is block diagram illustrating a configuration of a projector according to a first embodiment.

FIG. 1 is a block diagram illustrating an example of the configuration of a projector 20A to which a display device according to a first embodiment is applied. The projector 20A, which is one example of an electronic device, includes a display device 11A according to the first embodiment, and a processing circuit 25. The display device 11A is a self light emitting type RGB panel that displays each color of red, green, and blue.

The processing circuit 25 is supplied with image data Vin from a higher level device such as a host device, which is not illustrated, in synchronization with a synchronization signal Sync. For example, the image data Vin designates a gray scale level for a pixel in an image to be displayed, in eight bits for each RGB. The synchronization signal Sync includes a vertical synchronization signal that gives an instruction to start vertical scanning of image data Vin, a horizontal synchronization signal that gives an instruction to start horizontal scanning, and a clock signal that indicates timing at which one display pixel is supplied in the image data Vin.

The processing circuit 25 holds a one-frame period of or plural-frame period of image data Vdata from a higher level device. The processing circuit 25 supplies the collected image data Vdata to the display device 11A.

On the basis of the synchronization signal Sync, the processing circuit 25 generates a control signal Ctr used to control the display device 11A, and supplies the control signal Ctr to the display device 11A.

The display pixel represents a pixel of an image to which the image data Vdata designates a gray scale level. The panel pixel represents a pixel of an image expressed by the display device 11A.

The display device 11A displays an image indicated by the image data Vdata outputted by the processing circuit 25. In the display device 11A, an OLED is used as a light emitting element used to display an image. Note that the OLED stands for an organic light emitting diode.

Figure 2:
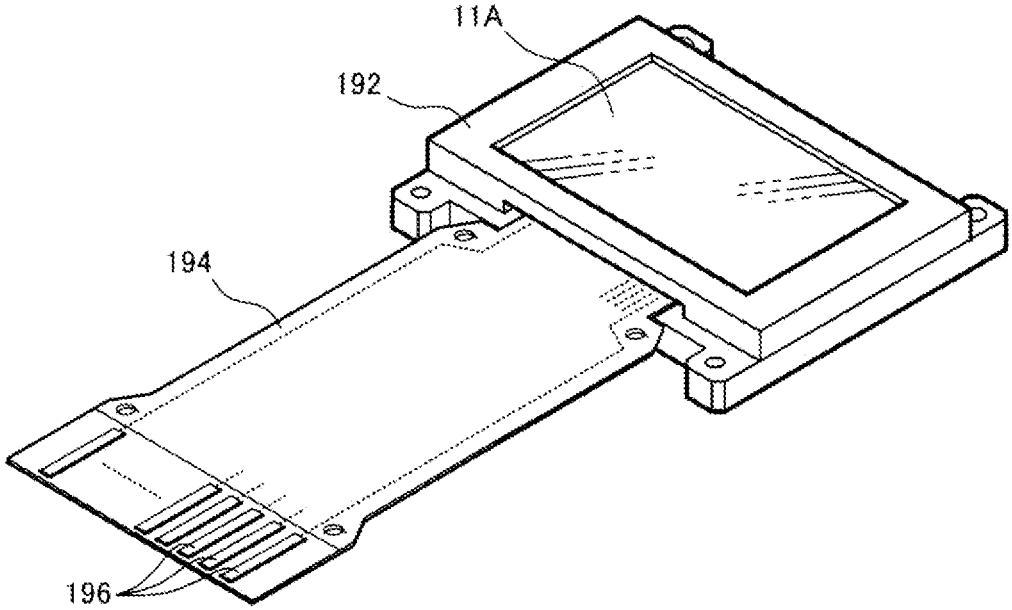
FIG. 2 is a perspective view illustrating a configuration of a display device.

FIG. 2 is a perspective view illustrating the configuration of the display device 11A. The display device 11A is accommodated in a case 192 having a frame shape and opened at the display region. One end of an FPC substrate 194 is coupled to the display device 11A. Note that the FPC stands for a flexible printed circuit. The other end of the FPC substrate 194 includes a plurality of terminals 196 used to be coupled to the processing circuit 25. The image data Vdata and the control signal Ctr are supplied to the display device 11A from the processing circuit 25 through the plurality of terminals 196 and the FPC substrate 194.

Figure 3:
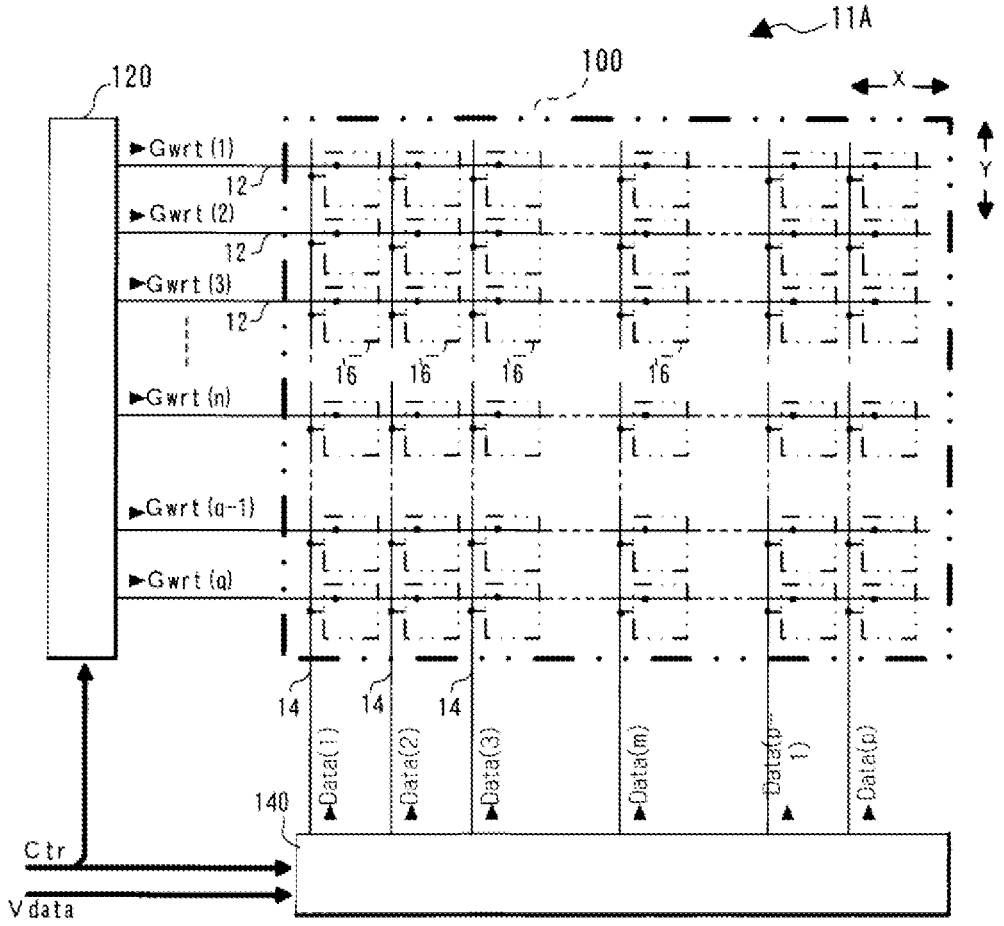
FIG. 3 is a block diagram illustrating an example of an electrical configuration of the display device.

FIG. 3 is a block diagram illustrating an example of the electrical configuration of the display device 11A. The display device 11A is generally separated into a display region 100, a scanning line drive circuit 120, and a data-signal output circuit 140. In the display region 100, q rows of scanning lines 12 are provided along a left-right X-axis in the drawing, and p columns of data lines 14 are provided along an up-down Y-axis so as to be electrically insulated from individual scanning lines 12. Note that p and q are integers equal to or more than 2. In the display region 100, pixel circuits 16 are provided so as to correspond to intersections of q rows of scanning lines 12 and p columns of data lines 14 as illustrated in the drawing.

The scanning line drive circuit 120 supplies scanning signals Gwrt(1), Gwrt(2), . . . , Gwrt(q−1), and Gwrt(q) to scanning lines 12 in first, second, . . . , (q−1)-th, and q-th rows in accordance with the control signal Ctr. Typically, the Gwrt(n) represents a scanning signal supplied to a scanning line 12 in the n-th row. Note that the scanning line drive circuit 120 sequentially selects, row by row, scanning lines 12 in the first to q-th rows in each sub-frame. The scanning signal supplied to the selected scanning line 12 is set as an L level, and scanning signals supplied to the other scanning lines 12 are set to as an H level. Furthermore, in addition to the scanning signals Gwrt(1) to Gwrt(q), the scanning line drive circuit 120 generates control signals Sel(1)_1 to Sel(1)_9 to control signals Sel(q)_1 to Sel(q)_9 so as to correspond to respective rows, the control signals being synchronized with the corresponding scanning signals. The scanning line drive circuit 120 supplies them to the display region 100. The control signals Sel(1)_1 to Sel(1)_9 to the control signals Sel(q)_1 to Sel(q)_9 are not illustrated in FIG. 3.

The data-signal output circuit 140 converts the image data Vdata outputted from the processing circuit 25 into an analog format. Then, in accordance with the control signal Ctr, the data-signal output circuit 140 supplies data signals Data(1), Data(2), Data(p−1), and Data(p) to the data lines 14 in the first, second, . . . , (p−1)-th, and p-th columns, respectively. Typically, the Data(m) represents a data signal supplied to a data line 14 in the m-th column. Note that, specifically, when the scanning signal Gwrt(n) is set as the L level, the data-signal output circuit 140 outputs a data signal Data(m) corresponding to a pixel circuit 16 at the n-th row and m-th column, to a data line 14 in the m-th column.

In addition, the conversion of the image data Vdata into the analog format is not limited to the conversion by the data-signal output circuit 140. This conversion may be performed by another DA converter or may be performed by a higher level device.

Figure 4:
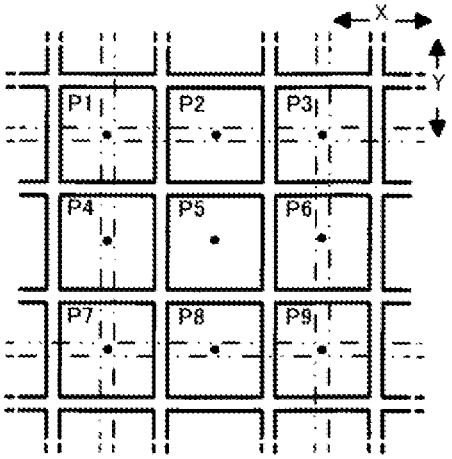
FIG. 4 is a diagram illustrating arrangement of pixel electrodes in a display region of the display device.
Figure 5:
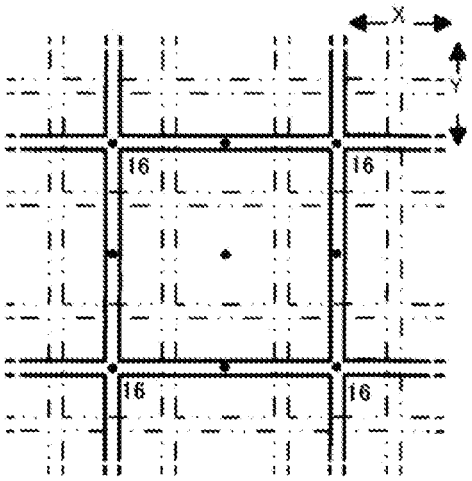
FIG. 5 is a diagram illustrating arrangement of pixel circuits in the display region.

FIGS. 4 and 5 are diagrams used to explain a positional relationship between a pixel circuit 16 and light emitting elements in the display region 100. Note that, in FIG. 4, a pixel electrode is illustrated as a frame with a thick solid line, and a region of the pixel circuit 16 is illustrated as a frame with a thin long dashed double-short dashed line. The pixel electrode is an anode electrode of the light emitting element 18 in FIG. 6 described later. On the other hand, in FIG. 5, a pixel electrode is illustrated as a frame with a thin long dashed double-short dashed line, and a region of the pixel electrode 16 is illustrated as a frame with a thick solid line.

In the present embodiment, each of pixel electrodes has, for example, substantially a square shape. The pixel electrodes are arrayed in a matrix manner such that one side of a pixel electrode extends along the X-axis, and sides adjacent to the one side extend in the Y-axis. In addition, a region where a pixel circuit 16 is provided has a size substantially equal to the size of a region where 2×2 of pixel electrodes are arrayed. Note that four corners of a region where a pixel circuit 16 is provided are each located substantially at the diagonal center of each of pixel electrodes at the upper left end, the upper right end, the lower left end, and the lower right end in FIG. 4 from among pixel electrodes arrayed in 3×3. In FIGS. 4 and 5, each black dot indicates a diagonal center of a pixel electrode.

Of pixel electrodes arrayed in 3×3, a pixel electrode included in a region where a pixel circuit 16 is provided is denoted as a reference character P5, and other pixel electrodes are denoted as reference characters P1 to P4 and P6 to P9 as illustrated in FIG. 4, for the purpose of convenience. The light emitting element 18 in the present embodiment is an element in which an organic light emitting material is interposed between any one of the pixel electrodes P1 to P9 and a common electrode, which is well known. The common electrode is coupled to a power supply line that supplies a low-potential power supply voltage Vss. In the following description, a pixel circuit 16 located directly below the pixel electrode P5 may be referred to as a target pixel circuit 16. The light emitting elements 18 corresponding to the respective pixel electrodes P1 to P9 are examples of first to ninth light emitting elements according to the present disclosure. Note that, for the purpose of convenience, the reference characters for the pixel electrodes P1 to P4 and the reference characters for the pixel electrodes P6 to P9 are labeled by focusing on a certain pixel circuit 16. For example, the pixel electrode P2 from the viewpoint of the target pixel circuit 16 is equal to the pixel electrode P8 from the viewpoint of a pixel circuit 16 located directly above this target pixel circuit 16. Furthermore, the pixel electrode P1 from the viewpoint of the target pixel circuit 16 is equal to the pixel electrode P7 from the viewpoint of a pixel circuit 16 located directly above this target pixel circuit 16, is equal to the pixel electrode P9 from the viewpoint of a pixel circuit 16 adjacent diagonally upper left to this target pixel circuit 16, and is equal to the pixel electrode P3 from the viewpoint of a pixel circuit 16 adjacent leftward to the target pixel circuit 16.

Figure 6:
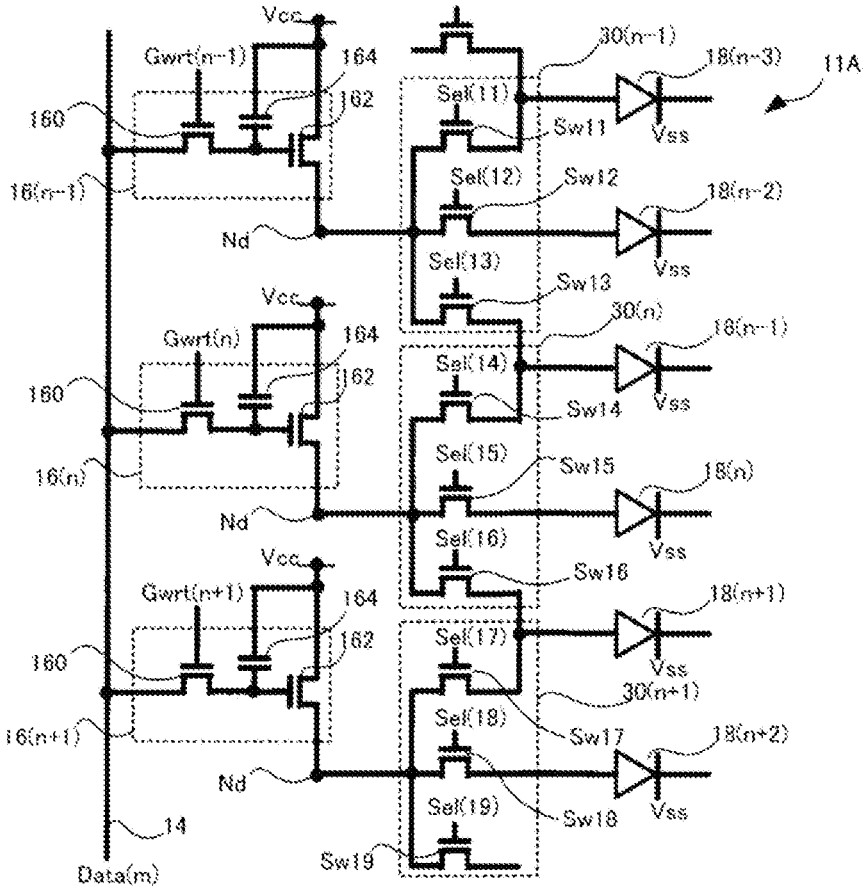
FIG. 6 is a diagram illustrating details of an example of an electrical configuration of the display device.

Of q×p pieces of pixel circuits arrayed in q rows and p columns in the display region 100, FIG. 6 illustrates only portions related to the pixel circuit 16($n$−1) located in the (n−1)-th row of the m-th column, the pixel circuit 16($n$) located in the n-th row, and the pixel circuit 16($n$+1) located in the (n+1)-th row. In the present embodiment, n is an integer equal to or more than 3.

The pixel circuit 16($n$−1), the pixel circuit 16($n$), and the pixel circuit 16($n$+1) each have the same configuration. In the following description, the pixel circuit 16($n$−1), the pixel circuit 16($n$), and the pixel circuit 16($n$+1) are each referred to as a pixel circuit 16 unless they need to be distinguished from each other.

For example, the pixel circuit 16 includes a transistor 160 and a transistor 162, each of which is a p-channel type transistor, and also includes a capacitor 164. In the transistor 160, the drain node is coupled to the data line 14, the gate node is coupled to the scanning line 12, and the source node is coupled to the gate node of the transistor 162. The transistor 160 is a switching element used to acquire the data signal supplied from the data line 14, in accordance with the scanning signal provided from the scanning line 12. In the transistor 162, the drain node is coupled to the power supply line used to supply a high-potential power supply voltage Vcc, and the source node serves as an output node Nd of the pixel circuit 16. The transistor 162 is a drive transistor that outputs, to the output node Nd, a current corresponding to a potential of the data signal to drive a light emitting element coupled to this output node. The capacitor 164 is interposed between the power supply line used to supply the high-potential power supply voltage Vcc and the gate node of the transistor 162.

Upon the scanning signal Gwrt(n) turning into the L level, the pixel circuit 16($n$) acquires the data signal Data(m) supplied from the data line 14 in the m-th column, and outputs, to the output node Nd, a current corresponding to a potential of the acquired data signal Data(m). This similarly applies to the pixel circuit 16($n$−1) and the pixel circuit 16($n$+1).

As illustrated in FIG. 6, the output node Nd of the pixel circuit 16($n$−1) is coupled to a selector 30($n$−1). The selector 30($n$−1) is coupled, in the display region 100, to a light emitting element 18($n$−3) located at the (n−3)-th row and m-th column, a light emitting element 18($n$−2) located at the (n−2)-th row and m-th column, and a light emitting element 18($n$−1) located at the (n−1)-th row and m-th column. As illustrated in FIG. 6, the selector 30($n$−1) includes transistors Sw11, Sw12, and Sw13. Each of the transistors Sw11, Sw12, and Sw13 is, for example, a p-channel type transistor.

The transistor Sw11 is provided between the output node Nd of the pixel circuit 16($n$−1) and the light emitting element 18($n$−3), and is turned on or off using the control signal Sel(11). Upon the transistor Sw11 being turned on, the output node Nd of the pixel circuit 16($n$−1) and the light emitting element 18($n$−3) are electrically coupled to each other. The transistor Sw12 is provided between the output node Nd of the pixel circuit 16($n$−1) and the light emitting element 18($n$−2), and is turned on or off using the control signal Sel(12). Upon the transistor Sw12 being turned on, the output node Nd of the pixel circuit 16($n$−1) and the light emitting element 18($n$−2) are electrically coupled to each other. The transistor Sw13 is provided between the output node Nd of the pixel circuit 16($n$−1) and the light emitting element 18($n$−1), and is turned on or off using the control signal Sel(13). Upon the transistor Sw13 being turned on, the output node Nd of the pixel circuit 16($n$−1) and the light emitting element 18($n$−1) are electrically coupled to each other. The selector 30($n$−1) can select the light emitting element 18($n$−3), the light emitting element 18($n$−2), and the light emitting element 18($n$−1), and supplies a current outputted from the pixel circuit 16($n$−1) to the selected light emitting element.

The output node Nd of the pixel circuit 16($n$) is coupled to the selector 30($n$). The selector 30($n$) is coupled, in the display region 100, to the light emitting element 18($n$−1) located at the (n−1)-th row and m-th column, a light emitting element 18($n$) located at the n-th row and m-th column, and a light emitting element 18($n$+1) located at the (n+1)-th row and m-th column. As illustrated in FIG. 6, the selector 30($n$) includes transistors Sw14, Sw15, and Sw16. The transistors Sw14, Sw15, and Sw16 are p-channel type transistors. The transistors Sw14, Sw15, and Sw16 are turned on or off using the control signals Sel(14), Sel(15), and Sel(16).

The transistor Sw14 is provided between the output node Nd of the pixel circuit 16($n$) and the light emitting element 18($n$−1). Upon the transistor Sw14 being turned on, the output node Nd of the pixel circuit 16($n$) and the light emitting element 18($n$−1) are electrically coupled to each other. The transistor Sw15 is provided between the output node Nd of the pixel circuit 16($n$) and the light emitting element 18($n$). Upon the transistor Sw15 being turned on, the output node Nd of the pixel electrode 16($n$) and the light emitting element 18($n$) are electrically coupled to each other. The transistor Sw16 is provided between the output node Nd of the pixel circuit 16($n$) and the light emitting element 18($n$+1). Upon the transistor Sw16 being turned on, the output node Nd of the pixel circuit 16($n$) and the light emitting element 18($n$+1) are electrically coupled to each other.

The selector 30($n$) can select the light emitting element 18($n$−1), the light emitting element 18($n$), and the light emitting element 18($n$+1), and supplies a current outputted from the pixel circuit 16($n$) to the selected light emitting element. The pixel circuit 16($n$) serves as an example of a first pixel circuit according to the present disclosure, and the selector 30($n$) serves as an example of a first selector according to the present disclosure. The transistor Sw15 serves as an example of a first transistor according to the present disclosure. The transistor Sw14 serves as an example of a second transistor according to the present disclosure. The transistor Sw16 serves as an example of a third transistor according to the present disclosure. A light emitting element 18 corresponding to the pixel electrode P5 from the viewpoint of the pixel circuit 16($n$), in other words, the light emitting element 18($n$) serves as an example of a first light emitting element according to the present disclosure. A light emitting element 18 corresponding to the pixel electrode P2 from the viewpoint of the pixel circuit 16($n$), in other words, the light emitting element 18($n$−1) serves as an example of a second light emitting element according to the present disclosure. A light emitting element 18 corresponding to the pixel electrode P8 from the viewpoint of the pixel circuit 16($n$), in other words, the light emitting element 18($n$+1) serves as an example of a third light emitting element according to the present disclosure. In addition, the pixel circuit 16($n$−1) serves as an example of a second pixel circuit according to the present disclosure, and the selector 30($n$−1) serves as an example of a second selector according to the present disclosure. The light emitting element 18($n$−3) serves as an example of an eleventh light emitting element according to the present disclosure, and the light emitting element 18($n$−2) serves as an example of a tenth light emitting element according to the present disclosure. The transistor Sw11 serves as an example of an eleventh transistor according to the present disclosure. The transistor Sw12 serves as an example of a tenth transistor according to the present disclosure. The transistor Sw13 serves as an example of a twelfth transistor according to the present disclosure.

The output node Nd of the pixel circuit 16($n$+1) is coupled to the selector 30($n$+1). The selector 30($n$+1) is coupled, in the display region 100, to the light emitting element 18($n$+1) located at the (n+1)-th row and m-th column, and a light emitting element 18($n$+2) located at the (n+2)-th row and m-th column. Although illustration is not given in FIG. 6, the selector 30($n$+1) is also coupled to a light emitting element located at the (n+3)-th row and m-th column. As illustrated in FIG. 6, the selector 30($n$+1) includes transistors Sw17, Sw18, and Sw19. The transistors Sw17, Sw18, and Sw19 are p-channel type transistors.

The transistor Sw17 is provided between the output node Nd of the pixel circuit 16($n$+1) and the light emitting element 18($n$+1). The transistor Sw17 is turned on or off using the control signal Sel(17). The transistor Sw18 is provided between the output node Nd of the pixel circuit 16($n$+1) and the light emitting element 18($n$+2). The transistor Sw18 is turned on or off using the control signal Sel(18). Although illustration is not given in FIG. 6, the transistor Sw19 is provided between the output node Nd of the pixel circuit 16($n$) and a light emitting element located at the (n+3)-th row and m-th column. The transistor Sw19 is turned on or off using the control signal Sel(19). In other words, the selector 30($n$+1) can select the light emitting element 18($n$+1), the light emitting element 18($n$+2), and the light emitting element located at the (n+3)-th row and m-th column, and supplies a current outputted from the pixel circuit 16($n$) to the selected light emitting element.

Figure 7:
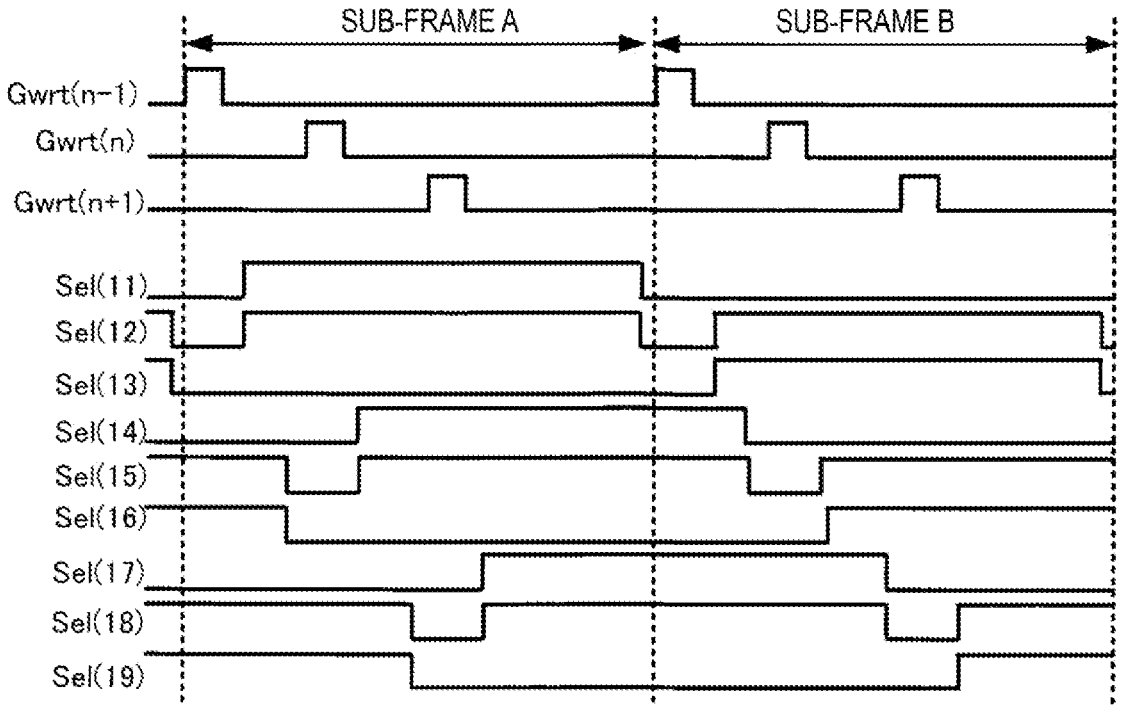
FIG. 7 is a diagram illustrating operation in the display region.

FIG. 7 is a diagram used to explain operation concerning three continuous rows of the (n−1)-th row, the n-th row, and the (n+1)-th row. More specifically, FIG. 7 is a timing chart illustrating examples of scanning signals Gwrt(n−1), Gwrt(n), and Gwrt(n+1), the control signals Sel(11) to Sel(13) corresponding to the (n−1)-th row, the control signals Sel(14) to Sel(16) corresponding to the n-th row, and the control signals Sel(17) to Sel(19) corresponding to the (n+1)-th row.

In the present embodiment, a period of one frame is separated into a period of a sub-frame A and a period of a sub-frame B. The period of one frame represents a period of time required to display one frame of an image designated by the image data Vin. The sub-frame A according to the present embodiment serves as one example of one sub-frame according to the present disclosure, and the sub-frame B serves as one example of a sub-frame differing from this one sub-frame. As illustrated in FIG. 7, in each sub-frame of the sub-frame A and the sub-frame B, the scanning signals Gwrt(n−1), Gwrt(n), and Gwrt(n+1) exclusively turn into the L level in this order. Note that, in the following description, the L level of the scanning signal Gwrt and the control signal Sel is referred to as "on-signal" and the H level is referred to as "off-signal." In addition, the high level side in the timing chart is set as "on-signal" and the low level side is set as "off-signal," for the purpose of convenience.

First, operation concerning the sub-frame A will be described.

In the sub-frame A, the scanning signal Gwrt(n) changes from the off-signal to the on-signal, and changes to the off-signal after a first predetermined period of time elapses. Upon the scanning signal Gwrt(n) turning into the on-signal, the transistor 160 in the pixel circuit 16($n$) is turned on. Once the transistor 160 is turned on, a voltage corresponding to a difference between a data signal Data(m) given to the data line 14 and the high-potential power supply voltage Vcc is written in the capacitor 164 of the pixel circuit 16($n$). After the scanning signal Gwrt(n) changes from the on-signal to the off-signal, the voltage written in the capacitor 164 is maintained until the scanning signal Gwrt(n) changes into the on-signal again in the next time. Thus, until the scanning signal Gwrt(n) changes into the on-signal again, a voltage across the gate and the source of the transistor 162 in the pixel circuit 16(*n*) is also maintained at a voltage corresponding to the data signal Data(m), specifically, at a voltage corresponding to a difference between the data signal Data(m) and the high-potential power supply voltage Vcc.

In the sub-frame A, the scanning signal Gwrt(n) changes from the off-signal to the on-signal, and then changes into the off-signal after the first predetermined period of time elapses. After this, the control signals Sel(14) and Sel(15) turn into the on-signal. Thus, the transistors Sw14 and Sw15 are turned on. This causes a current corresponding to a potential of the data signal Data(m) to be supplied from the pixel circuit 16(*n*) to the light emitting element 18(*n*−1) and the light emitting element 18(*n*), thereby causing the light emitting element 18(*n*−1) and the light emitting element 18(*n*) to emit light.

Before the scanning signal Gwrt(n) turns into the on-signal in the sub-frame A, the scanning signal Gwrt(n−1) changes from the off-signal to the on-signal, and after the first predetermined period of time elapses, the scanning signal Gwrt(n−1) changes to the off-signal. Then, the control signals Sel(11) and Sel(12) are turned into the on-signal, which results in the transistors Sw11 and Sw12 being turned on. This causes a current corresponding to a potential of the data signal Data(m) to be supplied from the pixel circuit 16(*n*−1) to the light emitting element 18(*n*−3) and the light emitting element 18(*n*−2), thereby causing the light emitting element 18(*n*−3) and the light emitting element 18(*n*−2) to emit light. In the sub-frame A, after the scanning signal Gwrt(n) turns into the on-signal, the scanning signal Gwrt (n+1) changes from the off-signal to the on-signal, and after the first predetermined period of time elapses, the scanning signal Gwrt(n+1) changes to the off-signal. Then, the control signals Sel(17) and Sel(18) turn into the on-signal, which results in the transistors Sw17 and Sw18 being turned on. This causes a current corresponding to a potential of the data signal Data(m) to be supplied from the pixel circuit 16(*n*+1) to the light emitting element 18(*n*+1) and the light emitting element 18(*n*+2), thereby causing the light emitting element 18(*n*+1) and the light emitting element 18(*n*+2) to emit light.

Next, operation concerning the sub-frame B will be described.

In the sub-frame B, the scanning signal Gwrt(n) changes from the off-signal to the on-signal, and then changes into the off-signal after the first predetermined period of time elapses. After this, the control signals Sel(15) and Sel(16) turn into the on-signal. Thus, the transistors Sw15 and Sw16 are turned on. This causes a current corresponding to a potential of the data signal Data(m) to be supplied from the pixel circuit 16(*n*) to the light emitting element 18(*n*) and the light emitting element 18(*n*+1), thereby causing the light emitting element 18(*n*−1) and the light emitting element 18(*n*) to emit light.

Before the scanning signal Gwrt(n) turns into the on-signal in the sub-frame B, the scanning signal Gwrt(n−1) changes from the off-signal to the on-signal, and after the first predetermined period of time elapses, the scanning signal Gwrt(n−1) changes to the off-signal. Then, the control signals Sel(12) and Sel(13) are turned into the on-signal, which results in the transistors Sw12 and Sw13 being turned on. This causes a current corresponding to a potential of the data signal Data(m) to be supplied from the pixel circuit 16(*n*−1) to the light emitting element 18(*n*−2) and the light emitting element 18(*n*−1), thereby causing the light emitting element 18(*n*−2) and the light emitting element 18(*n*−1) to emit light. After the scanning signal Gwrt(n) turns into the on-signal in the sub-frame B, the scanning signal Gwrt(n+1) changes from the off-signal to the on-signal, and after the first predetermined period of time elapses, the scanning signal Gwrt(n+1) changes to the off-signal. Then, the control signals Sel(18) and Sel(19) are turned into the on-signal, which results in the transistors Sw18 and Sw19 being turned on. This causes a current corresponding to a potential of the data signal Data(m) to be supplied from the pixel circuit 16(*n*+1) to the light emitting element 18(*n*+2) and a light emitting element 18 located at the (n+3)-th row and m-th column, thereby causing these light emitting elements to emit light.

Figure 8:
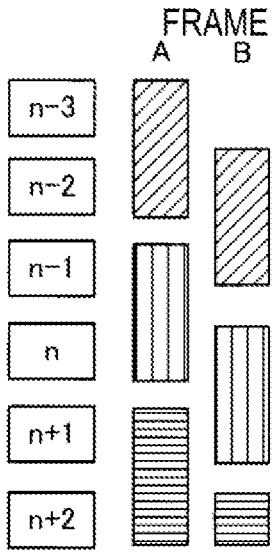
FIG. 8 is a diagram illustrating operation in the display region.

FIG. 8 is a diagram illustrating a relationship between a light emitting element 18 that emits light in the display device 11A in the sub-frame A and a pixel circuit 16 that supplies a current to this light emitting element 18. In FIG. 8, a light emitting element 18 that receives supply of a current from a pixel circuit 16(*n*−1) is illustrated with hatching of diagonal lines. A light emitting element 18 that receives supply of a current from a pixel circuit 16(*n*) is illustrated with hatching of vertical lines. A light emitting element 18 that receives supply of a current from a pixel circuit 16(*n*+1) is illustrated with hatching of horizontal lines. Note that FIG. 8 does not clearly illustrate a state of the light emitting element 18(*n*−3) emitting light in the sub-frame B. However, in the sub-frame B, the light emitting element 18(*n*−3) is selected by a selector 30(*n*−2), which is not illustrated in FIG. 6, and emits light with a current supplied from a pixel circuit 16(*n*−2), which is similarly not illustrated in the drawing. In other words, in the display device 11A, all the light emitting elements 18 are selected by a certain selector to emit light in both of the sub-frame A and the sub-frame B, which makes it possible to achieve the increased luminance.

With the display device 11A according to the present embodiment, it is possible to improve the feeling of resolution while suppressing an increase in the number of transistors, and also possible to achieve the increased luminance, as compared with a mode in which a pixel circuit is provided corresponding to a light emitting element on a one-to-one basis.

2. Second Embodiment

Figure 9:
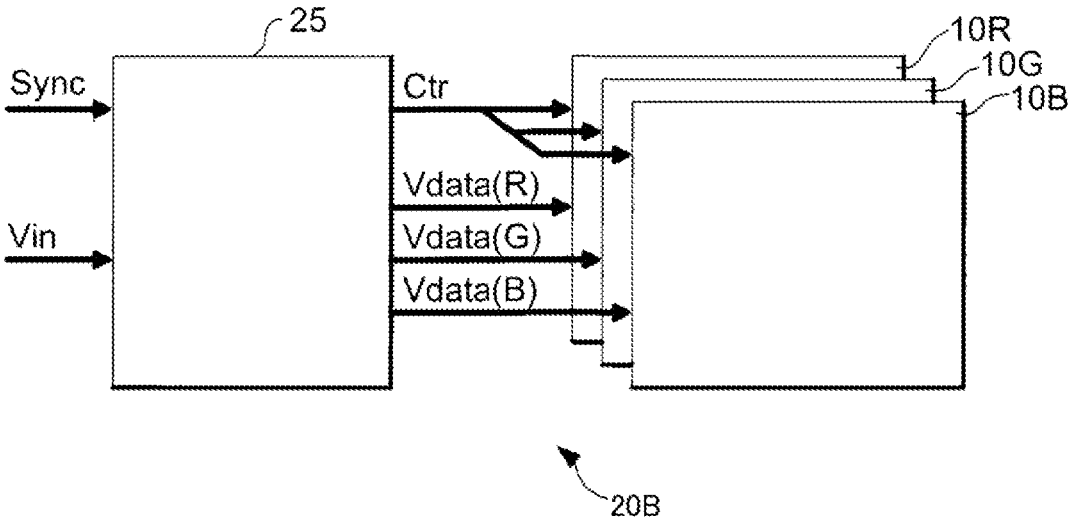
FIG. 9 is a block diagram illustrating a configuration of a projector according to a second embodiment.

FIG. 9 is a block diagram illustrating an example of the configuration of a projector 20B to which a display device according to a second embodiment is applied. The projector 20B is a three-plate type in which one self light emitting type display device that displays a single color is used for each color of red, green, and blue. The projector 20B includes a display device 10R that displays a red image, a display device 10G that displays a green image, a display device 10B that displays a blue image, and a processing circuit 25. The projector 20B combines the red image displayed by the display device 10R, the green image displayed by the display device 10G, and the blue image displayed by the display device 10B using an optical system, which is not illustrated, and projects the combined image onto a screen or the like.

The processing circuit 25 holds a one-frame period of or plural-frame period of image data Vin from a higher level device. In the present embodiment, of image data Vin that have been stored and collected, the processing circuit 25 supplies the display device 10R with image data Vdata(R) having a red component, the display device 10G with image data Vdata(G) having a green component, and the display device 10B with image data Vdata(B) having a blue component. In addition, the processing circuit 25 supplies the display devices 10R, 10G, and 10B with the control signals Ctr generated on the basis of the synchronization signals Sync. There is no difference in the structure between the display devices 10R, 10G, and 10B except for the colors of images to be displayed. Thus, the display devices 10R, 10G, and 10B are each referred to as a display device 10 when general description is made without specifying colors. In addition, as in the first embodiment, the image data Vdata (R), Vdata(G), and Vdata(B) outputted by the processing circuit 25 are each referred to as image data Vdata when general description is made without specifying colors.

In the present embodiment, one frame of an image indicated by the image data Vdata is expressed using four sub-frames from A to D. Therefore, if the speed is equal, the length of a period of one frame is equal to the length of a period of four sub-frames. Thus, on the assumption that the frequency of a vertical synchronization signal contained in the synchronization signal Sync is, for example, 60 Hz and displaying by the display device 10 is performed at a speed equal to the vertical synchronization signal, a period of time for supplying one frame of image data Vdata is 16.7 milliseconds, which is the inverse of 60 Hz. Thus, the length of a period of one sub-frame is 4.2 milliseconds, which is a quarter of 16.7 milliseconds.

Figure 10:
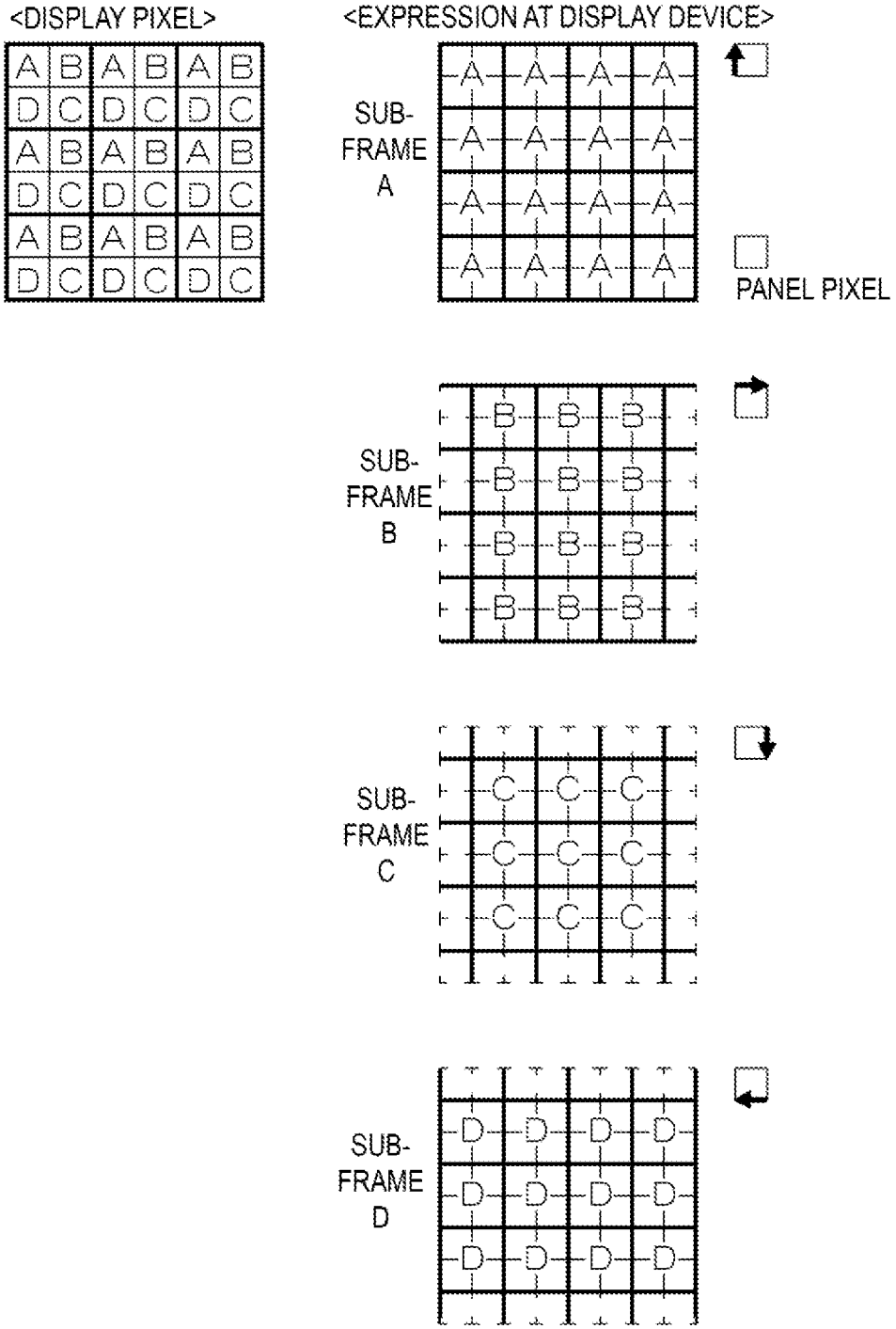
FIG. 10 is a diagram illustrating, for example, a relationship between an array of display pixels and an array of panel pixels.

FIG. 10 is a diagram used to explain a relationship or the like between an array of display pixels and an array of panel pixels according to the present embodiment. Note that, in the drawing, only part of the image designated by the image data Vdata is extracted to illustrate the array of display pixels. Similarly, only part of the display device 10 is extracted to illustrate the array of panel pixels. In the drawing, the display pixels in the left section are partitioned into 2×2, and the partitions are labeled with the reference characters of A, B, C, and D for the purpose of convenience. In addition, square boxes illustrated with a thin line in the right section of the drawing each indicate a pixel electrode in the display device 10. The square box indicating the pixel electrode is a minimum unit of display in the display device 10, and a light emitting element corresponding to this square box serves as a panel pixel.

In the display device 10, the display pixel A is express in the sub-frame A by four panel pixels of 2×2 indicated by the square box with a thick line. In the display device 10, in the sub-frame B following the sub-frame A, the display pixel B is expressed using four panel pixels of 2×2 that are shifted by one panel pixel toward the right direction in the drawing from the four panel pixels in the sub-frame A. Note that the shift as used herein does not mean that a panel pixel moves physically or optically but means that a combination of four panel pixels used for expression moves.

In the display device 10, in the sub-frame C following the sub-frame B, the display pixel C is expressed using panel pixels of 2×2 that are shifted downward by one panel pixel from the four panel pixels in the sub-frame B. In the display device 10, in the sub-frame D following the sub-frame C, the display pixel D is expressed using panel pixels of 2×2 that are shifted toward the left direction by one panel pixel from the four panel pixels in the sub-frame C. Note that, in the display device 10, after the sub-frame D, the display pixel A is expressed in the sub-frame A again using panel pixels of 2×2 that are shifted upward by one panel pixel from the four panel pixels in the sub-frame D.

Display pixels of 2×2 are set as one unit. When this one unit is arrayed in n rows and m columns, pixel circuits 16 are arrayed in n rows and m columns in the display device 10, and pixel electrodes are arrayed in 2n rows and 2m columns. Here, in a case of the sub-frame A, a data signal Data(m) corresponding to a pixel circuit 16 at the n-th row and m-th column means a signal obtained by converting, into an analog signal, data corresponding to the display pixel A among 2×2 display pixels at the n-th row and m-th column designated by the image data Vdata. In addition, in a case of the sub-frame B, a data signal Data(m) means a signal obtained by converting, into an analog signal, data corresponding to the display pixel B among the same 2×2 display pixels. Similarly, in a case of the sub-frame C, a data signal Data(m) means a signal obtained by converting, into an analog signal, data corresponding to the display pixel C among the same 2×2 display pixels. Furthermore, in a case of the sub-frame D, a data signal Data(m) means a signal obtained by converting, into an analog signal, data corresponding to the display pixel D among the same 2×2 display pixels.

In the present embodiment, the pixel electrodes P1 to P9 are classified in the following manner with respect to the output node of the target pixel circuit 16.

First, the pixel electrodes P1, P3, P7, and P9 located at four corners of the array of 3×3 are configured to be able to be coupled to the output node of the target pixel circuit 16 or the output node of any of the other three pixel circuits 16.

For example, the pixel electrode P1 is configured to be able to be coupled to any of the output node of the target pixel circuit 16, the output node of a pixel circuit 16 located directly above this target pixel circuit 16, the output node of a pixel circuit 16 adjacent diagonally upper left to this target pixel circuit 16, or the output node of a pixel circuit 16 adjacent leftward to this target pixel circuit 16.

The pixel electrode P3 is configured to be able to be coupled to any of the output node of the target pixel circuit 16, the output node of a pixel circuit 16 adjacent rightward to this target pixel circuit 16, the output node of a pixel circuit 16 adjacent diagonally upper right to this target pixel circuit 16, or the output node of a pixel circuit 16 located directly above this target pixel circuit 16.

The pixel electrode P7 is configured to be able to be coupled to any of the output node of the target pixel circuit 16, the output node of a pixel circuit 16 adjacent leftward to this target pixel circuit 16, the output node of a pixel circuit 16 adjacent diagonally lower left to this target pixel circuit 16, or the output node of a pixel circuit 16 located directly below this target pixel circuit 16.

The pixel electrode P9 is configured to be able to be coupled to any of the output node of the target pixel circuit 16, the output node of a pixel circuit 16 located directly below this target pixel circuit 16, the output node of a pixel circuit 16 adjacent diagonally lower right to this target pixel circuit 16, or the output node of a pixel circuit 16 adjacent rightward to this target pixel circuit 16.

Secondly, the pixel electrodes P2, P4, P6, and P8 in the array of 3×3 are configured to be able to be coupled to the output node of the target pixel circuit 16 or the output node of any of pixel circuits 16 adjacent upward, leftward, rightward, or downward to this target pixel circuit 16.

For example, the pixel electrode P2 is configured to be able to be coupled to any of the output node of the target pixel circuit 16 or the output node of a pixel circuit 16 located directly above this target pixel circuit 16.

The pixel electrode P4 is configured to be able to be coupled to any of the output node of the target pixel circuit 16 or the output node of a pixel circuit 16 adjacent leftward to this target pixel circuit 16.

The pixel electrode P6 is configured to be able to be coupled to any of the output node of the target pixel circuit 16 or the output node of a pixel circuit 16 adjacent rightward to this target pixel circuit 16.

The pixel electrode P8 is configured to be able to be coupled to any of the output node of the target pixel circuit 16 or the output node of a pixel circuit 16 located directly below this target pixel circuit 16.

Thirdly, the pixel electrode P5 located at the center of the array of 3×3 is configured to be able to be coupled only to the output node of the target pixel circuit 16.

As in the first embodiment, for the purpose of convenience, the reference characters for the pixel electrodes P1 to P4 and the reference characters for the pixel electrodes P6 to P9 are labeled with a certain pixel circuit 16 being focused. For example, the pixel electrode P2 from the viewpoint of the target pixel circuit 16 is equal to the pixel electrode P8 from the viewpoint of a pixel circuit 16 located directly above this target pixel circuit 16. Furthermore, the pixel electrode P1 from the viewpoint of the target pixel circuit 16 is equal to the pixel electrode P7 from the viewpoint of a pixel circuit 16 located directly above this target pixel circuit 16, is equal to the pixel electrode P9 from the viewpoint of a pixel circuit 16 adjacent diagonally upper left to this target pixel circuit 16, and is equal to the pixel electrode P3 from the viewpoint of a pixel circuit 16 adjacent leftward to the target pixel circuit 16.

Figure 11:
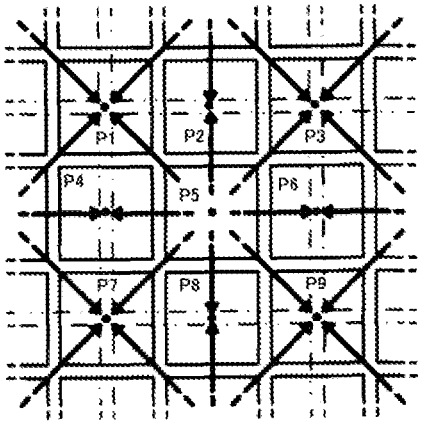
FIG. 11 is a diagram illustrating a connection between a pixel circuit and pixel electrodes.

FIG. 11 is a diagram illustrating a relationship of connection between a pixel circuit 16 and light emitting elements. In the drawing, the arrow starting from the output node of a pixel circuit 16 indicates light emitting elements to which the output node of this pixel circuit 16 is able to be coupled. In the present embodiment, the output node of the pixel circuit 16 is configured to be able to be coupled to any of the pixel electrodes P1 to P9 corresponding to a region where this pixel circuit 16 is provided, as described above. Note that the output node of the pixel circuit 16 and a pixel electrode of a light emitting element are coupled by a selector which will be described next.

Figure 12:
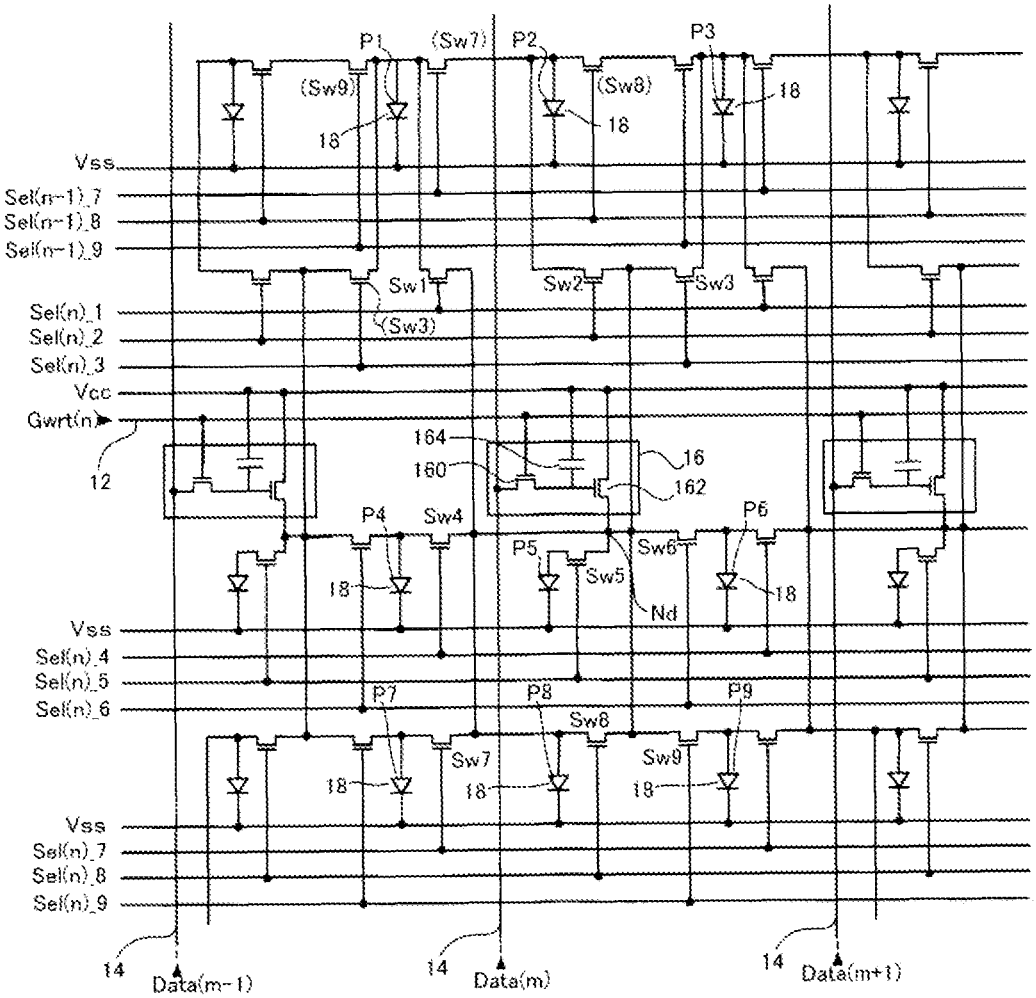
FIG. 12 is a circuit diagram illustrating a configuration of a display region.

FIG. 12 is a circuit diagram illustrating a pixel circuit 16, pixel electrodes P1 to P9, and the surrounding of these items. The pixel circuit 16 is provided so as to correspond to an intersection of a scanning line 12 in the n-th row and a data line 14 in the m-th column. The pixel electrodes P1 to P9 are pixel electrodes in a case where this pixel circuit 16 serves as the target pixel circuit 16.

The region of the selector includes transistors Sw1 to Sw9 although illustration is not given in the drawing in order to avoid complication. The transistor Sw1 is provided so as to correspond to the pixel electrode P1. Similarly, the transistors Sw2, Sw3, Sw4, Sw5, Sw6, Sw7, Sw8, and Sw9 are provided sequentially so as to correspond to the pixel electrodes P2, P3, P4, P5, P6, P7, P8, and P9, respectively. Each of the transistors Sw1 to Sw9 is a p-channel type transistor. Each of one ends of the transistors Sw1 to Sw9 is commonly coupled to the output node Nd. The other ends of the transistors Sw1 to Sw9 are coupled sequentially to corresponding pixel electrodes P1 to P9, respectively.

The control signals Sel(1)_1 to Sel(1)_9 to the control signals Sel(q)_1 to Sel(q)_9 are supplied from the scanning line drive circuit 120 so as to correspond to the first row to the q-th row. Here, typically, control signals supplied so as to correspond to the n-th row are denoted as Sel(n)_1 to Sel(n)_9. The transistor Sw1 provided so as to correspond to the n-th row is turned on when the control signal Sel(n)_1 is at the L level and is turned off when the control signal Sel(n)_1 is at the H level. Similarly, the transistors Sw2, Sw3, Sw4, Sw5, Sw6, Sw7, Sw8, and Sw9 provided so as to correspond to the n-th row are turned on or off sequentially in accordance with the control signals Sel(n)_2, Sel(n)_3, Sel(n)_4, Sel(n)_5, Sel(n)_6, Sel(n)_7, Sel(n)_8, and Sel(n)_9, respectively.

As described above, the pixel electrode P2 from the viewpoint of the pixel circuit 16 located at the n-th row and m-th column is equal to the pixel electrode P8 from the viewpoint of a pixel circuit 16 at the (n−1)-th row and m-th column adjacent on the upward side. Thus, the pixel electrode P2 from the viewpoint of the pixel circuit 16 at the n-th row and m-th column is coupled to the pixel circuit 16 at the (n−1)-th row and m-th column through the transistor Sw8 included in the selector corresponding to the pixel circuit 16 at the (n−1)-th row and m-th column. In addition, the pixel electrode P1 from the viewpoint of the pixel circuit 16 at the n-th row and m-th column is equal to the pixel electrode P7 from the viewpoint of the pixel circuit 16 at the (n−1)-th row and m-th column, is equal to the pixel electrode P9 from the viewpoint of a pixel circuit 16 at the (n−1)-th row and (m−1)-th column adjacent on the diagonally upper left side, and is equal to the pixel electrode P3 from the viewpoint of a pixel electrode 16 at the n-th row and (m−1)-th column adjacent on the left side. Thus, the pixel electrode P1 from the viewpoint of the pixel circuit 16 at the n-th row and m-th column is coupled to the output node of the pixel circuit 16 at the (n−1)-th row and m-th column through the transistor Sw7 included in a selector corresponding to the pixel circuit 16 at the (n−1)-th row and m-th column. In addition, the pixel electrode P1 from the viewpoint of the pixel circuit 16 at the n-th row and m-th column is coupled to the output node of the pixel circuit 16 at the (n−1)-th row and (m−1)-th column through the transistor Sw9 included in a selector corresponding to the pixel circuit 16 at the (n−1)-th row and (m−1)-th column. Yet furthermore, the pixel electrode P1 from the viewpoint of the pixel circuit 16 at the n-th row and m-th column is coupled to the output node of a pixel circuit 16 at the n-th row and (m−1)-th column through the transistor Sw3 included in a selector corresponding to the pixel circuit 16 at the n-th row and (m−1)-th column.

Figure 13:
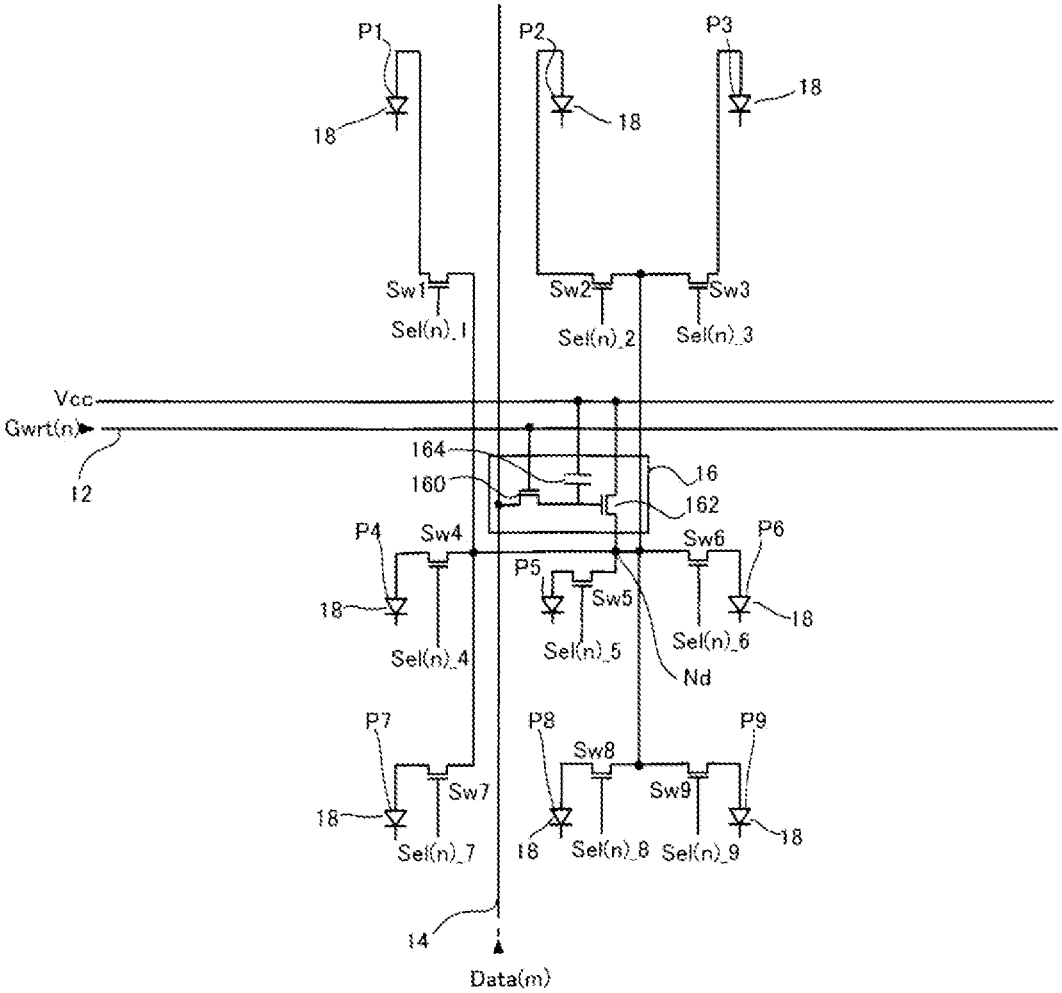
FIG. 13 is a circuit diagram illustrating a configuration of a display region.

Note that FIG. 13 is a diagram illustrated so as to focus on the pixel circuit 16 at the n-th row and m-th column, the transistors Sw1 to Sw9 included in the selector corresponding to the pixel circuit 16 at the n-th row and m-th column, and the pixel electrodes P1 to P9 from the viewpoint of this pixel circuit 16 in FIG. 12. The other elements are not illustrated in this drawing.

Next, operation of the display device 10 according to the present embodiment will be described.

Figure 14:
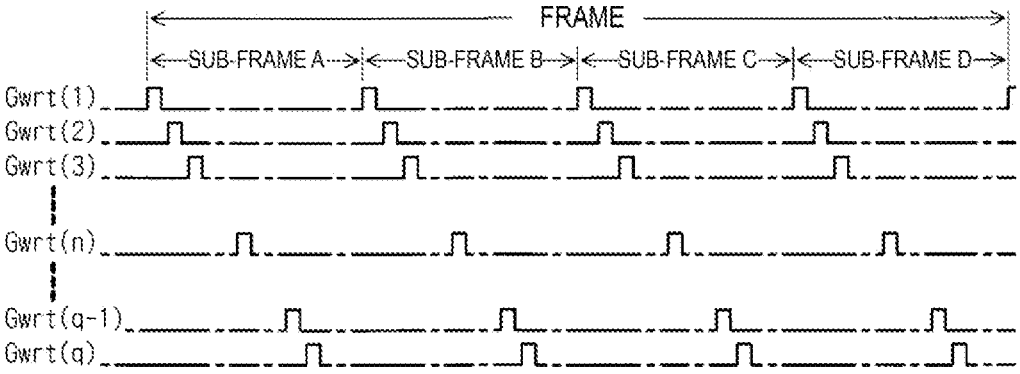
FIG. 14 is a diagram illustrating operation in a display region.

FIG. 14 is a timing chart illustrating one example of scanning signals Gwrt(1) to Gwrt(q) outputted from the scanning line drive circuit 120. As illustrated in the drawing, in each of the sub-frames of the sub-frame A, the sub-frame B, the sub-frame C, and the sub-frame D, the scanning signals Gwrt(1), Gwrt(2), Gwrt(n), Gwrt(q−1), and Gwrt(q) are exclusively turned into the on-signal in this order.

Figure 15:
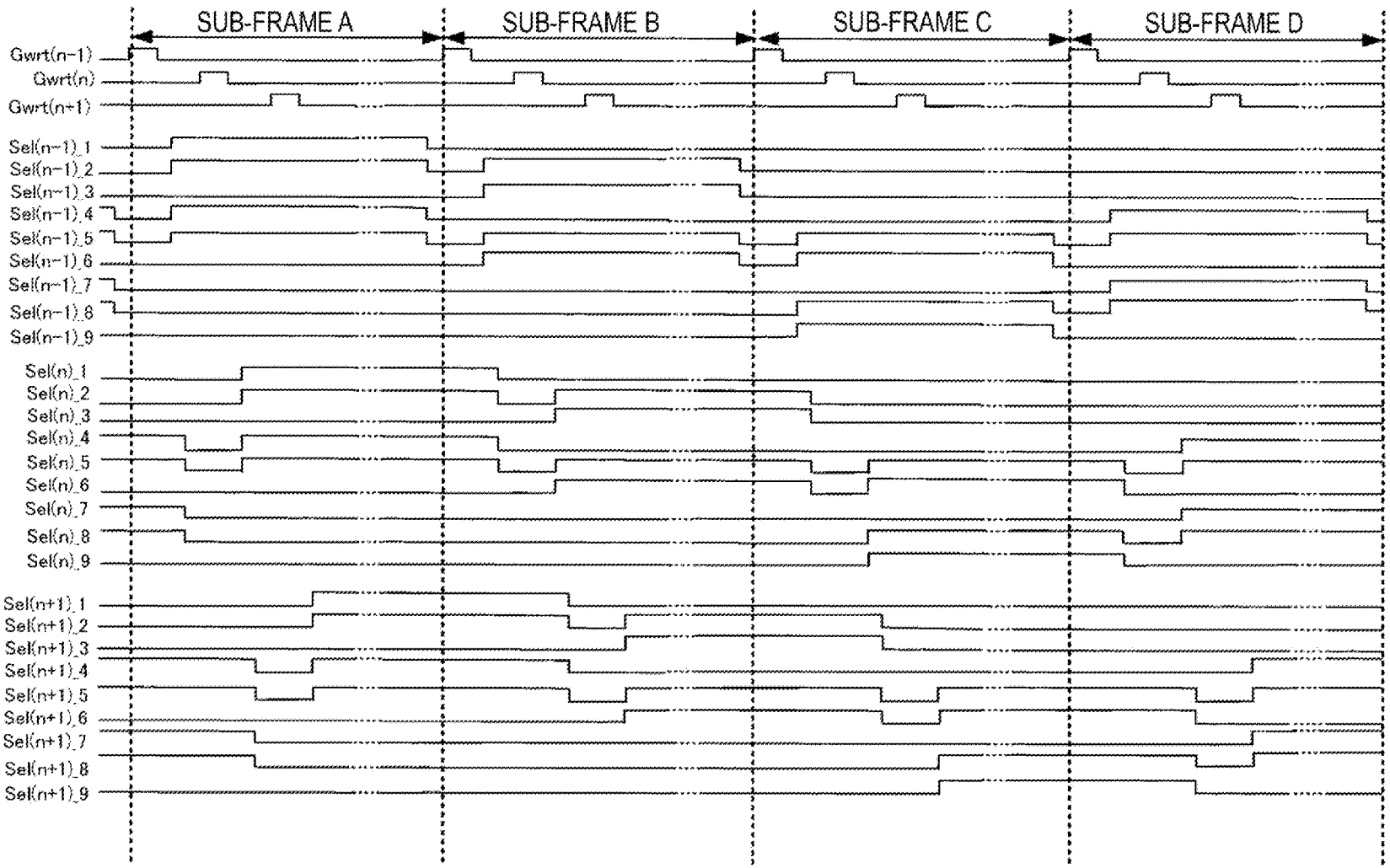
FIG. 15 is a diagram illustrating operation in a display region.

FIG. 15 is a diagram used to explain operation concerning three continuous rows of the (n−1)-th row, the n-th row, and the (n+1)-th row. Specifically, FIG. 15 is a timing chart illustrating examples of control signals Sel(n−1)_1 to Sel (n−1)_9 corresponding to the (n−1)-th row, control signals Sel(n)_1 to Sel(n)_9 corresponding to the n-th row, and control signals Sel(n+1)_1 to Sel(n+1)_9 corresponding to the (n+1)-th row.

First, operation concerning the sub-frame A will be described.

Upon the scanning signal Gwrt(n) turning into the on-signal, the transistor 160 in the pixel circuit 16 in the n-th row is turned on. Once the transistor 160 is turned on, a voltage corresponding to a difference between a data signal Data(m) given to the data line 14 and the high-potential power supply voltage Vcc is written in the capacitor 164. After the scanning signal Gwrt(n) changes from the on-signal to the off-signal, the voltage written in the capacitor 164 is maintained until the scanning signal Gwrt(n) changes into the on-signal again in the next time. Thus, until the scanning signal Gwrt(n) changes into the on-signal again, a voltage across gate and source of the transistor 162 is also maintained at a voltage corresponding to the data signal Data(m), specifically, at a voltage corresponding to a difference between the data signal Data(m) and the high-potential power supply voltage Vcc.

In the sub-frame A, after the scanning signal Gwrt(n) stays at the on-signal for the first predetermined period of time, the scanning signal Gwrt(n) changes to the off-signal. The first predetermined period of time is set so as to correspond to a period of time until writing to the capacitor 164 finishes. Upon the scanning signal Gwrt(n) changing to the off-signal, the control signals Sel(n)_1, Sel(n)_2, Sel(n)_4, and Sel(n)_5 change into the on-signal, and this state is maintained for a second predetermined period of time. Once the control signals Sel(n)_1, Sel(n)_2, Sel(n)_4, and Sel(n)_5 change to the on-signal, the transistors Sw1, Sw2, Sw4, and Sw5 in the n-th row are turned on. Once the transistors Sw1, Sw2, Sw4, and Sw5 in the n-th row are turned on, a current corresponding to a potential of the data signal Data(m) is supplied from the pixel circuit 16 in the n-th row to the pixel electrodes P1, P2, P4, and P5 from the viewpoint of this pixel circuit 16.

The n-th row and m-th column will be described as a representative. A current corresponding to a potential of the data signal Data(m) supplied to the data line 14 in the m-th column is supplied to the pixel electrodes P1, P2, P4, and P5 from the viewpoint of the pixel circuit 16 at the n-th row and m-th column. The data signal Data(m) at this time is a signal obtained by converting, into an analog signal, data corresponding to the display pixel A among 2×2 display pixels at the n-th row and m-th column designated by the image data Vdata. Thus, a current corresponding to a gray-scale of the display pixel A is supplied to four light emitting elements 18 corresponding to the respective pixel electrodes P1, P2, P4, and P5. This causes the four light emitting elements 18 corresponding to the respective pixel electrodes P1, P2, P4, and P5 to emit light having luminance corresponding to the gray-scale of the display pixel A.

Figure 16:
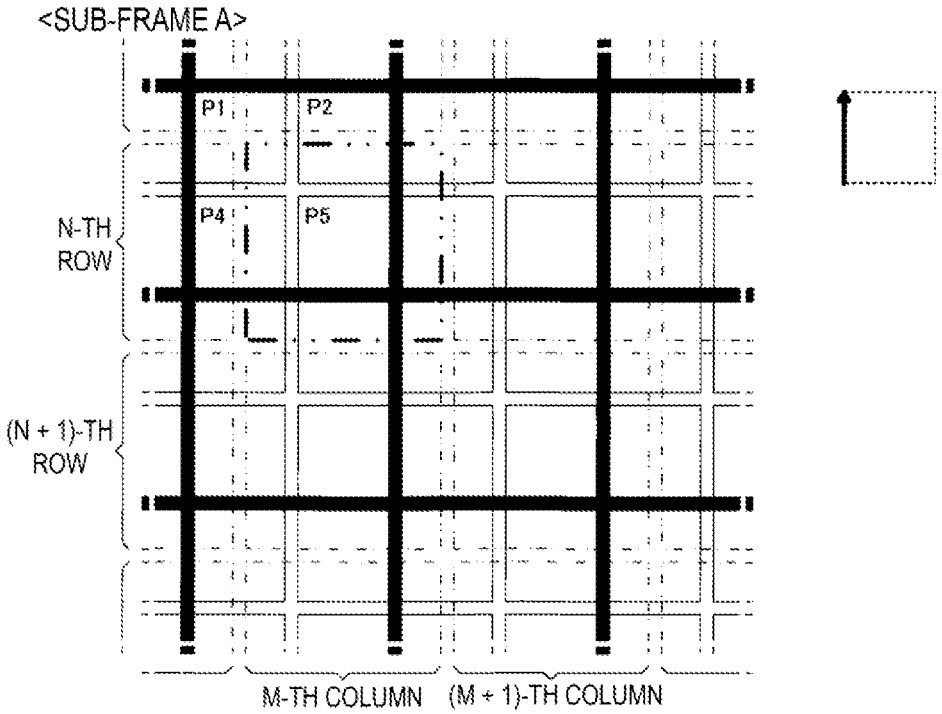
FIG. 16 is a diagram illustrating shift of panel pixels in a display region.

FIG. 16 is a diagram illustrating an example of display of the display device 10 in the sub-frame A. When the pixel circuit 16 at the n-th row and m-th column is illustrated using the thick long dashed double-short dashed line in the drawing, a current corresponding to a potential of the data signal Data(m) is supplied to the pixel electrodes P1, P2, P4, and P5 from the viewpoint of the pixel circuit 16 at the n-th row and m-th column. Note that, in a case of a pixel circuit 16 located in the n-th row and k-th column differing from the m-th column, a current corresponding to the gray-scale of the display pixel A is also supplied to the pixel electrodes P1, P2, P4, and P5 from the viewpoint of this pixel circuit 16.

Before the scanning signal Gwrt(n) turns into the on-signal in the sub-frame A, the scanning signal Gwrt(n−1) changes from the off-signal to the on-signal, and after the first predetermined period of time elapses, the control signals Sel(n−1)_1, Sel(n−1)_2, Sel(n−1)_4, and Sel(n−1)_5 change to the on-signal. This results in the transistors Sw1, Sw2, Sw4, and Sw5 in this (n−1)-th row being turned on. Thus, for the pixel circuit 16 in the (n−1)-th row, a current corresponding to a potential of the data signal is supplied to the corresponding pixel electrodes P1, P2, P4, and P5. In addition, in the sub-frame A, after the scanning signal Gwrt(n) returns to the off-signal, the scanning signal Gwrt (n+1) changes from the off-signal to the on-signal. Then, after the first predetermined period of time elapses, the scanning signal Gwrt(n+1) changes to the off-signal. After this, the control signals Sel(n+1)_1, Sel(n+1)_2, Sel(n+1)_4, and Sel(n+1)_5 turn into the on-signal, which results in the transistors Sw1, Sw2, Sw4, and Sw5 in this (n+1)-th row being turned on. Thus, a current corresponding to a potential of the data signal given to the data line 14 is also supplied to the pixel electrodes P1, P2, P4, and P5 corresponding to the pixel circuit 16 in the (n+1)-th row. Here, description has been made of the three continuous rows of the (n−1)-th row, n-th row, (n+1)-th row. However, this similarly applies to the first to q-th rows. As described above, in the sub-frame A, a current corresponding to the gray-scale of the display pixel A is supplied from the pixel circuit 16 in each of the rows to the corresponding pixel electrodes P1, P2, P4, and P5.

Next, operation concerning the sub-frame B will be described.

In the sub-frame B, the scanning signal Gwrt(n) changes from the off-signal to the on-signal, and after the first predetermined period of time elapses, the scanning signal Gwrt(n) changes to the off-signal. Then, the control signals Sel(n)_2, Sel(n)_3, Sel(n)_5, and Sel(n)_6 are turned into the on-signal, which results in the transistors Sw2, Sw3, Sw5, and Sw6 in the n-th row being turned on. At the n-th row and m-th column, a current corresponding to a potential of the data signal Data(m) is supplied to the pixel electrodes P2, P3, P5, and P6 corresponding to the pixel circuit 16 at this n-th row and m-th column. The data signal Data(m) at this time is a signal obtained by converting, into an analog signal, data corresponding to the display pixel B among 2×2 display pixels at the n-th row and m-th column designated by the image data Vdata. This causes the four light emitting elements 18 corresponding to the respective pixel electrodes P2, P3, P5, and P6 from the viewpoint of the pixel circuit 16 at the n-th row and m-th column to emit light having luminance corresponding to the gray-scale of the display pixel B.

Figure 17:
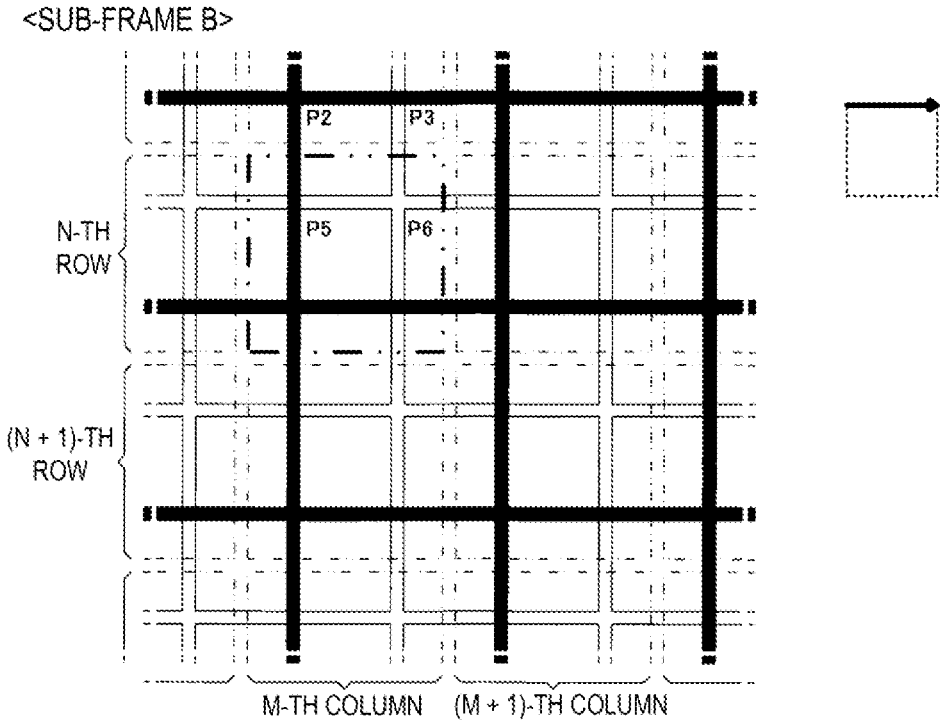
FIG. 17 is a diagram illustrating shift of panel pixels in a display region.

FIG. 17 is a diagram illustrating an example of display of the display device 10 in the sub-frame B.

At the n-th row and m-th column, a current corresponding to a potential of the data signal Data(m) is supplied to the pixel electrodes P2, P3, P5, and P6 from the viewpoint of the pixel circuit 16 at this n-th row and m-th column. In addition, the four light emitting elements 18 corresponding to the pixel electrodes P2, P3, P5, and P6 emit light having luminance corresponding to the gray-scale of the display pixel B. Note that, in a case of a pixel circuit 16 located in the n-th row and k-th column other than the m-th column, a current corresponding to a potential of the data signal Data(k) is also supplied to the pixel electrodes P2, P3, P5, and P6 from the viewpoint of this pixel circuit 16. In addition, the four light emitting elements 18 corresponding to the pixel electrodes P2, P3, P5, and P6 emit light having luminance corresponding to this current. In the sub-frame B, the scanning signal Gwrt(n−1) changes from the off-signal to the on-signal. After the first predetermined period of time elapses, the scanning signal Gwrt(n−1) changes to the off-signal. Then, the control signals Sel(n−1)_2, Sel(n)_3(*n*−1), Sel(n−1)_5, and Sel(n−1)_6 are turned into the on-signal. In addition, the scanning signal Gwrt(n+1) changes from the off-signal to the on-signal. After the first predetermined period of time elapses, the scanning signal Gwrt(n+1) changes to the off-signal. Then, the control signals Sel(n+1)_2, Sel(n+1)_3, Sel(n+1)_5, and Sel(n+1)_6 are turned into the on-signal. Furthermore, these are not limited to the (n−1)-th row, the n-th row, and the (n+1)-th row, and similarly apply to the first to q-th rows. Thus, in the sub-frame B, since the transistors Sw2, Sw3, Sw5, and Sw6 are turned on in each of the rows, a current corresponding to the gray-scale of the display pixel B is supplied from the pixel circuit 16 in each of the rows to the corresponding pixel electrodes P2, P3, P5, and P6.

In the sub-frame B, the pixel electrodes P2, P3, P5, and P6 are shifted by one pixel electrode in the right direction relative to the pixel electrodes P1, P2, P4, and P5. The pixel electrodes P2, P3, P5, and P6 are supplied with a current corresponding to the display pixel B from among 2×2 display pixels at the n-th row and m-th column designated by the image data Vdata. In the sub-frame A, the pixel electrodes P1, P2, P4, and P5 are supplied with a current corresponding to the display pixel A.

Next, operation concerning the sub-frame C will be described.

In the sub-frame C, the scanning signal Gwrt(n) changes from the off-signal to the on-signal. After the first predetermined period of time elapses, the scanning signal Gwrt(n) changes to the off-signal. Then, the control signals Sel(n)_5, Sel(n)_6, Sel(n)_8, and Sel(n)_9 are turned into the on-signal, which results in the transistors Sw5, Sw6, Sw8, and Sw9 in the n-th row being turned on. At the n-th row and m-th column, a current corresponding to a potential of the data signal Data(m) supplied to the data line 14 in the m-th column is supplied to the pixel electrodes P5, P6, P8, and P9 from the viewpoint of the pixel circuit 16 at this n-th row and m-th column. The data signal Data(m) at this time is a signal obtained by converting, into an analog signal, data corresponding to the display pixel C of 2×2 display pixels at the n-th row and m-th column designated by the image data Vin. This causes the four light emitting elements 18 corresponding to the respective pixel electrodes P5, P6, P8, and P9 from the viewpoint of the pixel circuit 16 at the n-th row and m-th column to emit light having luminance corresponding to the display pixel C.

Figure 18:
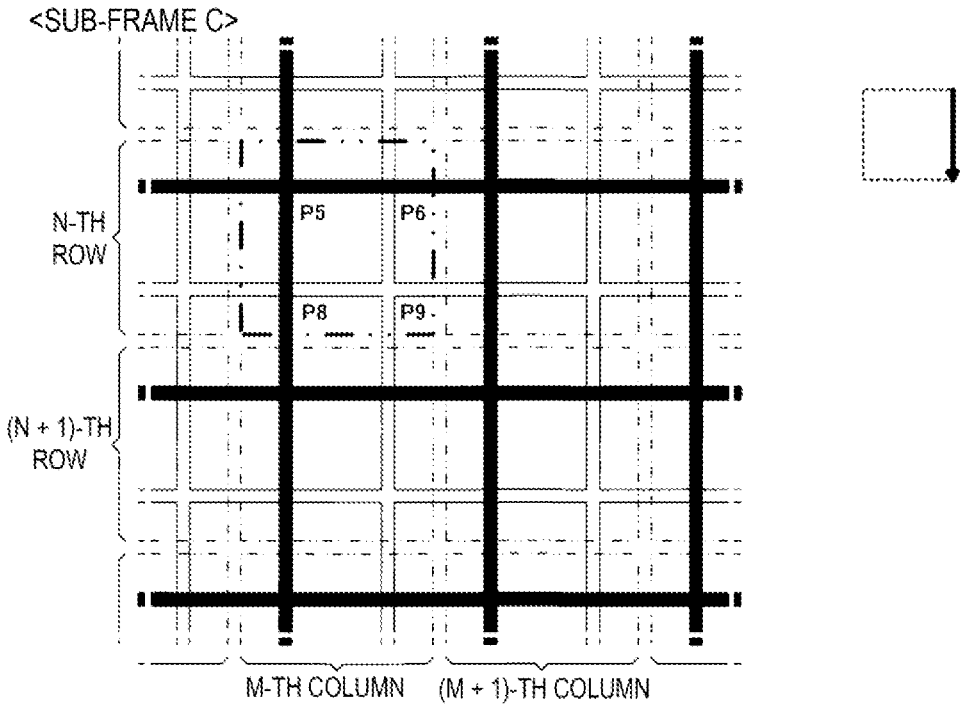
FIG. 18 is a diagram illustrating shift of panel pixels in a display region.

FIG. 18 is a diagram illustrating an example of display of the display device 10 in the sub-frame C.

At the n-th row and m-th column, a current corresponding to a potential of the data signal Data(m) is supplied to the four light emitting elements 18 corresponding to the respective pixel electrodes P5, P6, P8, and P9 from the viewpoint of the pixel circuit 16 at this n-th row and m-th column. In the sub-frame C, the scanning signal Gwrt(n−1) changes from the off-signal to the on-signal. After the first predetermined period of time elapses, the scanning signal Gwrt(n−1) changes to the off-signal. Then, the control signals Sel(n−1)_5, Sel(n−1)_6, Sel(n−1)_8, and Sel(n−1)_9 are turned into the on-signal. The scanning signal Gwrt(n+1) changes from the off-signal to the on-signal. After the first predetermined period of time elapses, the scanning signal Gwrt(n+1) changes to the off-signal. Then, the control signals Sel(n+1)_5, Sel(n+1)_6, Sel(n+1)_8, and Sel(n+1)_9 are turned into the on-signal. Furthermore, these are not limited to the (n−1)-th row, the n-th row, and the (n+1)-th row, and similarly apply to the first to q-th rows. Thus, in the sub-frame C, since the transistors Sw5, Sw6, Sw8, and Sw9 are turned on in each of the rows, a current corresponding to the gray-scale of the display pixel C is supplied to the pixel electrodes P5, P6, P8, and P9 from the viewpoint of the pixel circuit 16 in each of the rows.

In the sub-frame C, the pixel electrodes P5, P6, P8, and P9 are shifted downward by one pixel electrode relative to the pixel electrodes P2, P3, P5, and P6 that are supplied, in the sub-frame B, with a current corresponding to the display pixel B. The pixel electrodes P5, P6, P8, and P9 are supplied with a current corresponding to the display pixel C from among 2×2 display pixels at the n-th row and m-th column designated by the image data Vin.

Operation concerning the sub-frame D will be described.

In the sub-frame D, the scanning signal Gwrt(n) changes from the off-signal to the on-signal. After the first predetermined period of time elapses, the scanning signal Gwrt(n) changes to the off-signal. Then, the control signals Sel(n)_4, Sel(n)_5, Sel(n)_7, and Sel(n)_8 are turned into the on-signal, which results in the transistors Sw4, Sw5, Sw7, and Sw8 being turned on. At the n-th row and m-th column, a current corresponding to a potential of the data signal Data(m) supplied to the data line 14 in the m-th column is supplied to the four light emitting elements 18 corresponding to the respective pixel electrodes P4, P5, P7, and P8 corresponding to the pixel circuit 16 at this n-th row and m-th column. The data signal Data(m) at this time is a signal obtained by converting, into an analog signal, data corresponding to the display pixel D of 2×2 display pixels at the n-th row and m-th column designated by the image data Vin. This causes the four light emitting elements 18 corresponding to the respective pixel electrodes P4, P5, P7, and P8 corresponding to the pixel circuit 16 at the n-th row and m-th column to emit light having luminance corresponding to the display pixel D.

Figure 19:
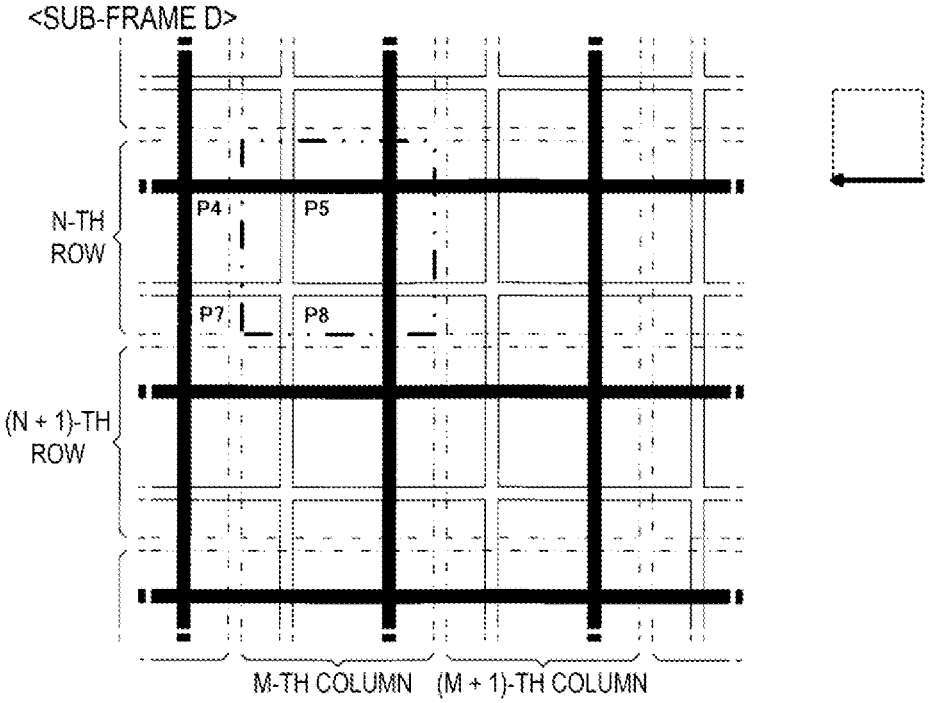
FIG. 19 is a diagram illustrating shift of panel pixels in a display region.

FIG. 19 is a diagram illustrating an example of display of the display device 10 in the sub-frame D.

At the n-th row and m-th column, a current corresponding to a potential of the data signal Data(m) is supplied to the pixel electrodes P4, P5, P7, and P8 from the viewpoint of the pixel circuit 16 at this n-th row and m-th column. In the sub-frame D, the scanning signal Gwrt(n−1) changes from the off-signal to the on-signal. After the first predetermined period of time elapses, the scanning signal Gwrt(n−1) changes to the off-signal. Then, the control signals Sel(n−1)_4, Sel(n−1)_5, Sel(n−1)_7, and Sel(n−1)_8 are turned into the on-signal. In addition, the scanning signal Gwrt(n+1) changes from the off-signal to the on-signal. After the first predetermined period of time elapses, the scanning signal Gwrt(n+1) changes to the off-signal. Then, the control signals Sel(n+1)_4, Sel(n+1)_5, Sel(n+1)_7, and Sel(n+1)_8 are turned into the on-signal. Furthermore, these are not limited to the (n−1)-th row, the n-th row, and the (n+1)-th row, and similarly apply to the first to the q-th rows. Thus, in the sub-frame D, since the transistors Sw4, Sw5, Sw7, and Sw8 are turned on in each of the rows, a current corresponding to a potential of the data signal Data(m) is supplied to the pixel electrodes P4, P5, P7, and P8 from the viewpoint of the pixel circuit 16 in each of the rows.

In the sub-frame D, the pixel electrodes P4, P5, P7, and P8 are shifted by one pixel electrode in the left direction relative to the pixel electrodes P5, P6, P8, and P9. The pixel electrodes P4, P5, P7, and P8 are supplied with a data signal corresponding to the display pixel D from among 2×2 display pixels at the n-th row and m-th column designated by the image data Vdata. In the sub-frame C, the pixel electrodes P5, P6, P8, and P9 are supplied with the data signal corresponding to the display pixel C. Note that, after the sub-frame D, the operation returns to the sub-frame A. In the sub-frame A, the pixel electrodes P1, P2, P4, and P5 are shifted upward by one pixel electrode relative to the pixel electrodes P4, P5, P7, and P8 that are supplied, in the sub-frame D, with the current corresponding to the display pixel D. The pixel electrodes P1, P2, P4, and P5 are supplied with a current corresponding to the display pixel A.

Figure 20:
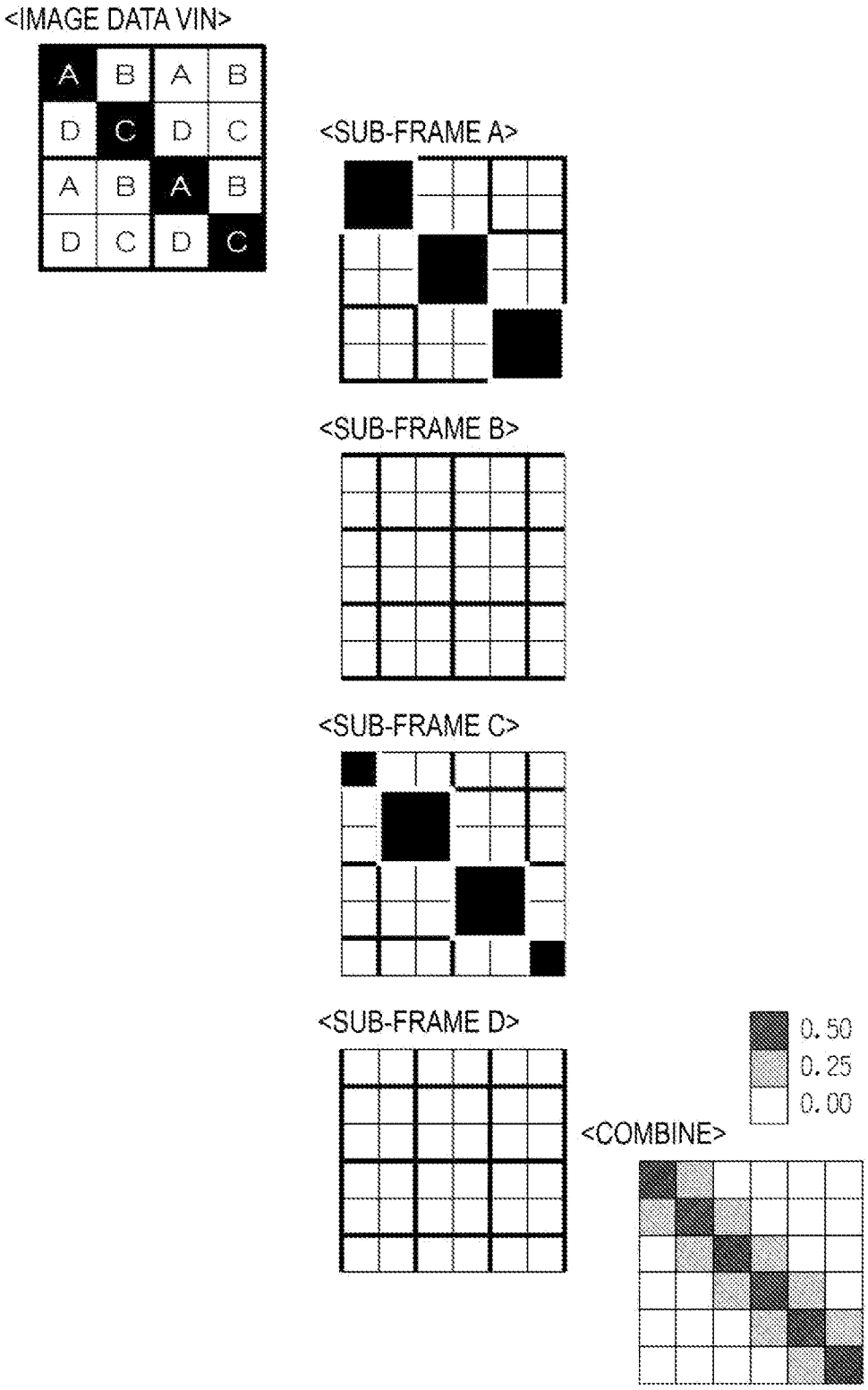
FIG. 20 is a diagram illustrating an example of display of the display device.

FIG. 20 is a diagram used to explain how visual recognition is made with display pixels designated by the image data Vdata and panel pixels displayed by the display device 10. Description will be made of a case where an image indicated by the image data Vdata is, for example, a still image of a black diagonal line on a white background as illustrated in the drawing, specifically, a case where, among a portion of 2×2 display pixels, the display pixel A and the display pixel C are black, the display pixel B and the display pixel D are white, and other 2×2 display pixels, which are backgrounds, are all white.

In this case, in the sub-frame A, black is displayed in a region equivalent to four pixel electrodes corresponding to 2×2 display pixels that constitute a portion of the display device 10, and white is displayed in a region equivalent to four pixel electrodes serving as a background. Note that, in the drawing, a region equivalent to four pixel electrodes of the display device is illustrated as a black frame with a thick line.

In the sub-frame B, 2×2 of four pixel electrodes corresponding to display pixels are shifted by one pixel electrode in the right direction. Note that all are displayed in white in the sub-frame B. Here, four pixel electrodes are focused. However, in the display device 10, entire combinations of 2×2 pixel electrodes are moved in the display region 100.

In the sub-frame C, four pixel electrodes corresponding to display pixels are shifted downward by the amount equivalent to one pixel electrode. In the display device 10, black is displayed in a region equivalent to four pixel electrodes corresponding to 2×2 display pixels that constitute a portion of the device, and white is displayed in a region equivalent to four pixel electrodes serving as a background.

In the sub-frame D, four pixel electrodes corresponding to display pixels are shifted in the left direction by the amount equivalent to one pixel electrode, and all are displayed in white.

Note that, after the sub-frame D, the operation returns to the sub-frame A, and four pixel electrodes are shifted upward by the amount equivalent to one pixel electrode.

As described above, in the present embodiment, in any of the four sub-frames from the sub-frame A to the sub-frame D, four panel pixels used in expression are adjacent to each other, and individual combinations of these four panel pixels are shifted in every sub-fame. When four sub-frames from the sub-frame A to the sub-frame D constitute a unit period, the display expressed in the display device 10 is visually recognized as a combined image as illustrated in the drawing. As described above, in the present embodiment, even if a pixel circuit 16 is arrayed so as to be vertically halved and horizontally halved with respect to display pixels, a combined image, which is visually recognized with four sub-frames being a unit period, can have substantially the same resolution as an image designated by the image data Vdata. In other words, according to the present embodiment, it is possible to improve the feeling of resolution that a user can feel while reducing the number of transistors by the number of transistors constituting the pixel circuit 16, as compared with a mode in which a pixel circuit 16 is provided corresponding to a light emitting element on a one-to-one basis.

In the present embodiment, combinations of four pixel electrodes used to express display pixels are moved to shift panel pixels, thereby achieving visual recognition. Such shifting of panel pixels can be also achieved by using an optical element to shift the optical axis of light outputted from the display device 10. However, shifting of the optical element works on all the panel pixels of the display device, in other words, works equally to the panel pixels. Thus, in a configuration in which scanning lines 12 are selected sequentially from the first row to the q-th row, the following problem arises if, for example, shifting is performed by using the optical element in a retrace period after the selection of the last q-th row until the selection of the first row in the next sub-frame. Specifically, in such a configuration, the state before shifting is performed using the optical element is almost visually recognized for the panel pixel in the topmost first row, whereas the state after shifting is performed using the optical element is almost visually recognized for the panel pixel in the last q-th row, which results in a difference between them. That is, the states of shifting using the optical element are visually recognized differently from row to row.

In contrast, the display device 10 according to the present embodiment uses the transistors Sw1 to Sw9 to switch pixel electrodes that are supplied with a data signal acquired by the pixel circuit 16, thereby shifting panel pixels. That is, in a case of the display device 10, panel pixels are shifted at the time when the data signal is supplied to the pixel electrodes, which, in principle, avoids occurrence of the inconvenience in which the state of shifting is visually recognized differently from row to row.

In addition, with the present embodiment, in the four sub-frames from the sub-frame A to the sub-frame D, all the light emitting elements 18 are selected by any of the selectors to emit light. Thus, it is possible to achieve the increased luminance. Note that, in the present embodiment, the pixel circuit 16 located at the n-th row and m-th column serves as one example of a first pixel circuit according to the present disclosure, and the pixel circuit 16 located at the (n−1)-th row and m-th column serves as one example of a second pixel circuit according to the present disclosure.

In addition, the light emitting elements 18 corresponding to respective pixel electrodes P1 to P9 from the viewpoint of the pixel circuit 16 located at the n-th row and m-th column serves as examples of first to ninth light emitting elements according to the present disclosure.

The light emitting element 18 corresponding to the pixel electrode P1 serves as one example of the sixth light emitting element according to the present disclosure.

The light emitting element 18 corresponding to the pixel electrode P2 serves as one example of the second light emitting element according to the present disclosure.

The light emitting element 18 corresponding to the pixel electrode P3 serves as one example of the ninth light emitting element according to the present disclosure.

The light emitting element 18 corresponding to the pixel electrode P4 serves as one example of the fifth light emitting element according to the present disclosure.

The light emitting element 18 corresponding to the pixel electrode P5 serves as one example of the first light emitting element according to the present disclosure.

The light emitting element 18 corresponding to the pixel electrode P6 serves as one example of the eighth light emitting element according to the present disclosure.

The light emitting element 18 corresponding to the pixel electrode P7 serves as one example of the fourth light emitting element according to the present disclosure.

The light emitting element 18 corresponding to the pixel electrode P8 serves as one example of the third light emitting element according to the present disclosure.

The light emitting element 18 corresponding to the pixel electrode P9 serves as one example of the seventh light emitting element according to the present disclosure.

In addition, the transistors Sw1 to Sw9 corresponding to the pixel circuit 16 located at the n-th row and m-th column serve as examples of first to ninth transistors according to the present disclosure.

The transistor Sw1 serves as one example of the sixth transistor according to the present disclosure.

The transistor Sw2 serves as one example of the second transistor according to the present disclosure.

The transistor Sw3 serves as one example of the ninth transistor according to the present disclosure.

The transistor Sw4 serves as one example of the fifth transistor according to the present disclosure.

The transistor Sw5 serves as one example of the first transistor according to the present disclosure.

The transistor Sw6 serves as one example of the eighth transistor according to the present disclosure.

The transistor Sw7 serves as one example of the fourth transistor according to the present disclosure.

The transistor Sw8 serves as one example of the third transistor according to the present disclosure.

The transistor Sw9 serves as one example of the seventh transistor according to the present disclosure.

The transistors Sw1 to Sw9 corresponding to the pixel circuit 16 located at the n-th row and m-th column, in other words, the transistors Sw1 to Sw9 illustrated in FIG. 13 constitute a first selector according to the present disclosure.

In addition, the transistors Sw1 to Sw9 corresponding to the pixel circuit 16 located at the (n−1)-th row and m-th column constitute a second selector according to the present disclosure. The transistor Sw8 corresponding to the pixel circuit 16 located at the (n−1)-th row and m-th column serves as one example of a twelfth transistor according to the present disclosure. The transistor Sw9 corresponding to the pixel circuit 16 located at the (n−1)-th row and m-th column serves as one example of a thirteenth transistor according to the present disclosure. The transistor Sw7 corresponding to the pixel circuit 16 located at the (n−1)-th row and m-th column serves as one example of a fourteenth transistor according to the present disclosure.

In addition, the sub-frame C according to the present embodiment serves as one example of a first sub-frame according to the present disclosure, in other words, one sub-frame. The sub-frame A according to the present embodiment serves as one example of a third sub-frame that is a sub-frame differing from this one sub-frame. The sub-frame D serves as one example of a second sub-frame according to the present disclosure. The sub-frame B serves as one example of a fourth sub-frame. The present embodiment employs the order of the sub-frame A→the sub-frame B→the sub-frame C→the sub-frame D (→the sub-frame A). However, the order may be reversed so as to be the sub-frame D→the sub-frame C→the sub-frame B→the sub-frame A (→the sub-frame D). In addition, the starting sub-frame in a certain frame may be any of the sub-frame A, the sub-frame B, the sub-frame C, or the sub-frame D.

3. Third Embodiment

The second embodiment is configured such that panel pixels corresponding to four pixel electrodes are shifted in two axes of the X-axis and the Y-axis. However, it may be possible to employ a configuration in which shifting is performed in one axis angled at 45 degrees relative to the X-axis or the Y-axis. Thus, next, description will be made of a third embodiment in which shifting is performed in one axis. Note that a display device according to the third embodiment can be simply achieved, for example, by alternately repeating the sub-frame A and the sub-frame C in the display device according to the second embodiment.

Conversely speaking, by employing a configuration of alternately repeating the sub-frame A and the sub-frame C, it is possible to eliminate an element used to perform display using the sub-frame B and the sub-frame D. Thus, description will be made of the third embodiment in which an element used to perform display using the sub-frame B and the sub-frame D is removed from the display device 10 according to the second embodiment.

Figure 21:
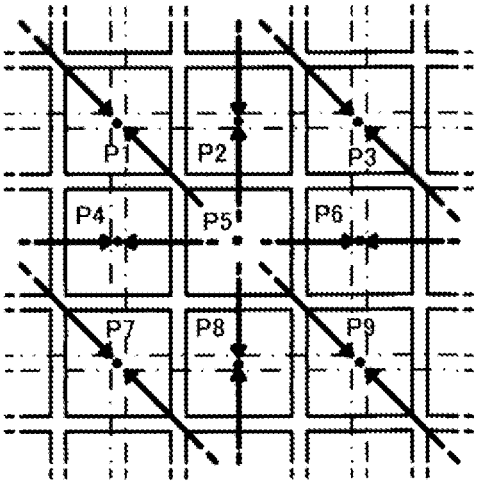
FIG. 21 is a diagram illustrating a connection between a pixel circuit and pixel electrodes.

FIG. 21 is a diagram illustrating a relationship of connection between a pixel circuit 16 and pixel electrodes in the display device 10 according to the third embodiment. The meaning of the arrows in the drawing is similar to that in FIG. 11. In the third embodiment, the output node of a pixel circuit 16 can be coupled to any of the pixel electrodes P1, P2, P4, P5, P6, P8, and P9 corresponding to a region where this pixel circuit 16 is provided.

Figure 22:
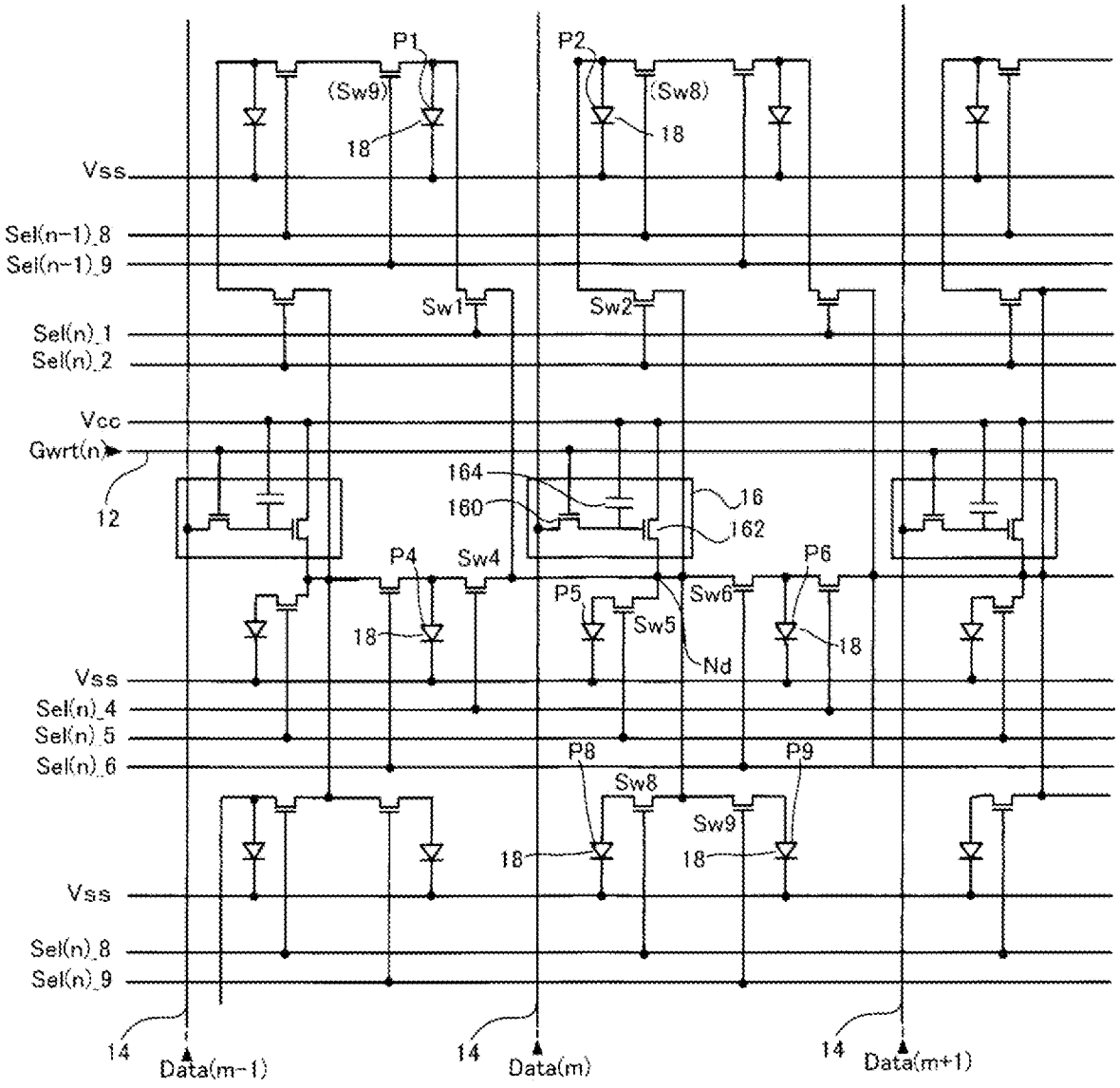
FIG. 22 is a circuit diagram illustrating a configuration of a display region.

FIG. 22 is a circuit diagram illustrating a pixel circuit 16, pixel electrodes P1 to P9, and the surrounding of these items. The pixel circuit 16 is provided so as to correspond to an intersection of a scanning line 12 in the n-th row and a data line 14 in the m-th column. The pixel electrodes P1 to P9 are pixel electrodes in a case where this pixel circuit 16 serves as the target pixel circuit 16.

In the third embodiment, since the output node Nd of the pixel circuit 16 does not need to be coupled to the pixel electrodes P3 and P7, the transistors Sw3 and Sw7 are not provided, as compared with the configuration illustrated in FIG. 12. Thus, the control signals Sel(1)_3 to Sel(q)_3 to the transistor Sw3 or the control signals Sel(1)_7 to Sel(q)_7 to the transistor Sw7 are also not supplied from the scanning line drive circuit 120.

Figure 23:
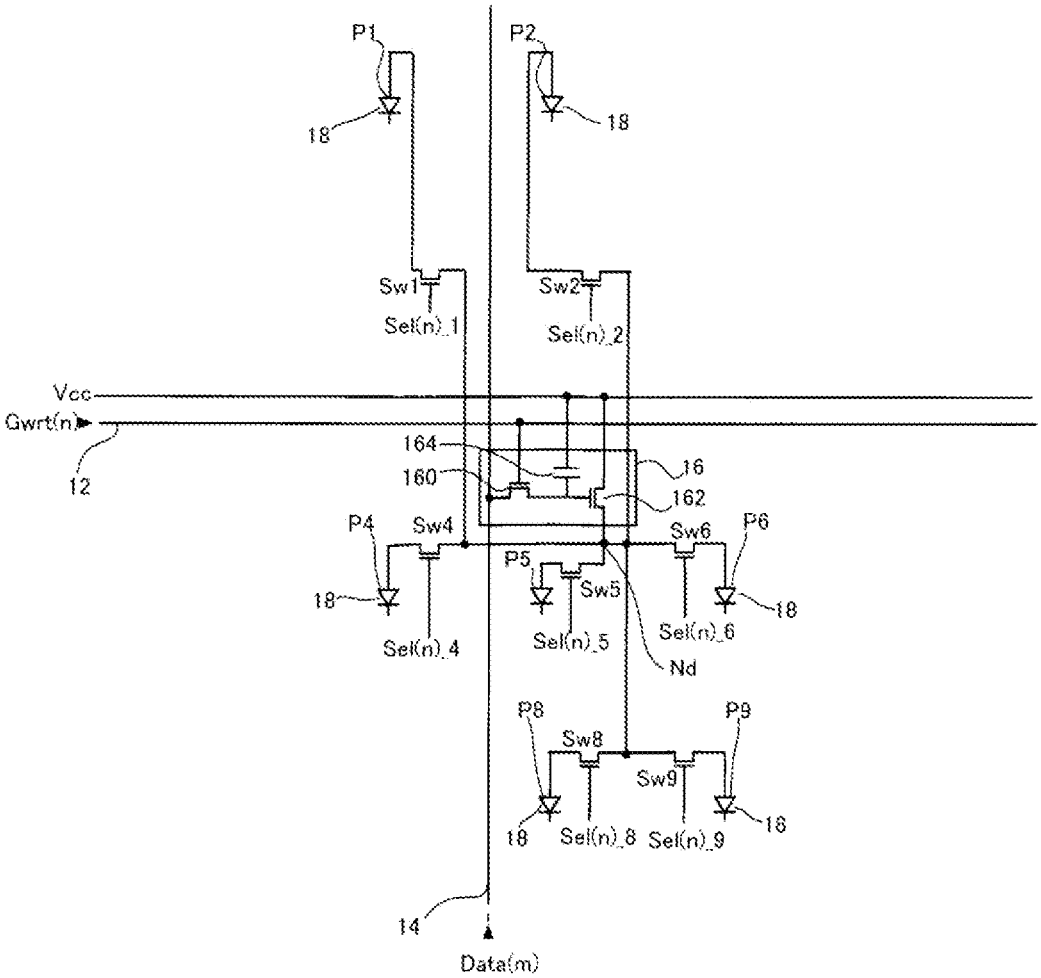
FIG. 23 is a circuit diagram illustrating a configuration of a display region.

FIG. 23 is a diagram illustrated so as to focus on the pixel circuit 16 at the n-th row and m-th column, the transistors Sw1, Sw2, Sw4, Sw5, Sw6, Sw8, and Sw9, and the pixel electrodes P1 to P9 from the viewpoint of this pixel circuit 16 in FIG. 22. The other elements are not illustrated in this drawing.

Figure 24:
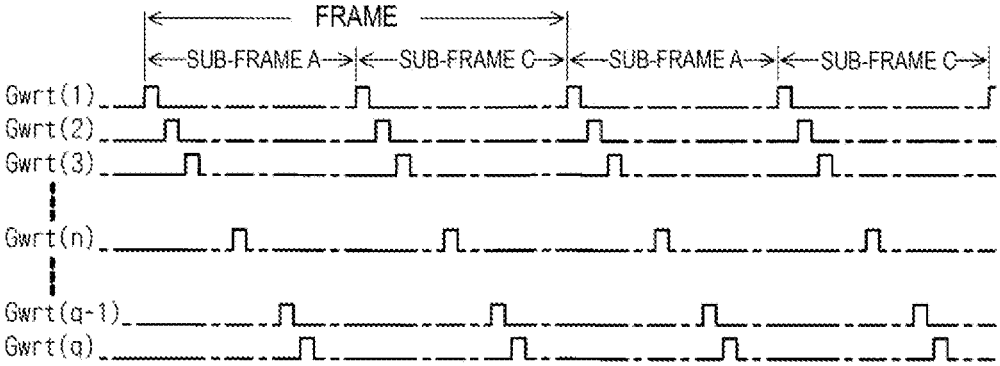
FIG. 24 is a diagram illustrating operation in a display region.

Next, operation of the display device 10 according to the third embodiment will be described. FIG. 24 is a timing chart illustrating examples of scanning signals Gwrt(1) to Gwrt(q) outputted from the scanning line drive circuit 120. As illustrated in the drawing, in the sub-frame A and the sub-frame C, the scanning signals Gwrt(1), Gwrt(2), Gwrt(n), Gwrt(q−1), and Gwrt(q) are exclusively turned into the on-signal in this order.

Figure 25:
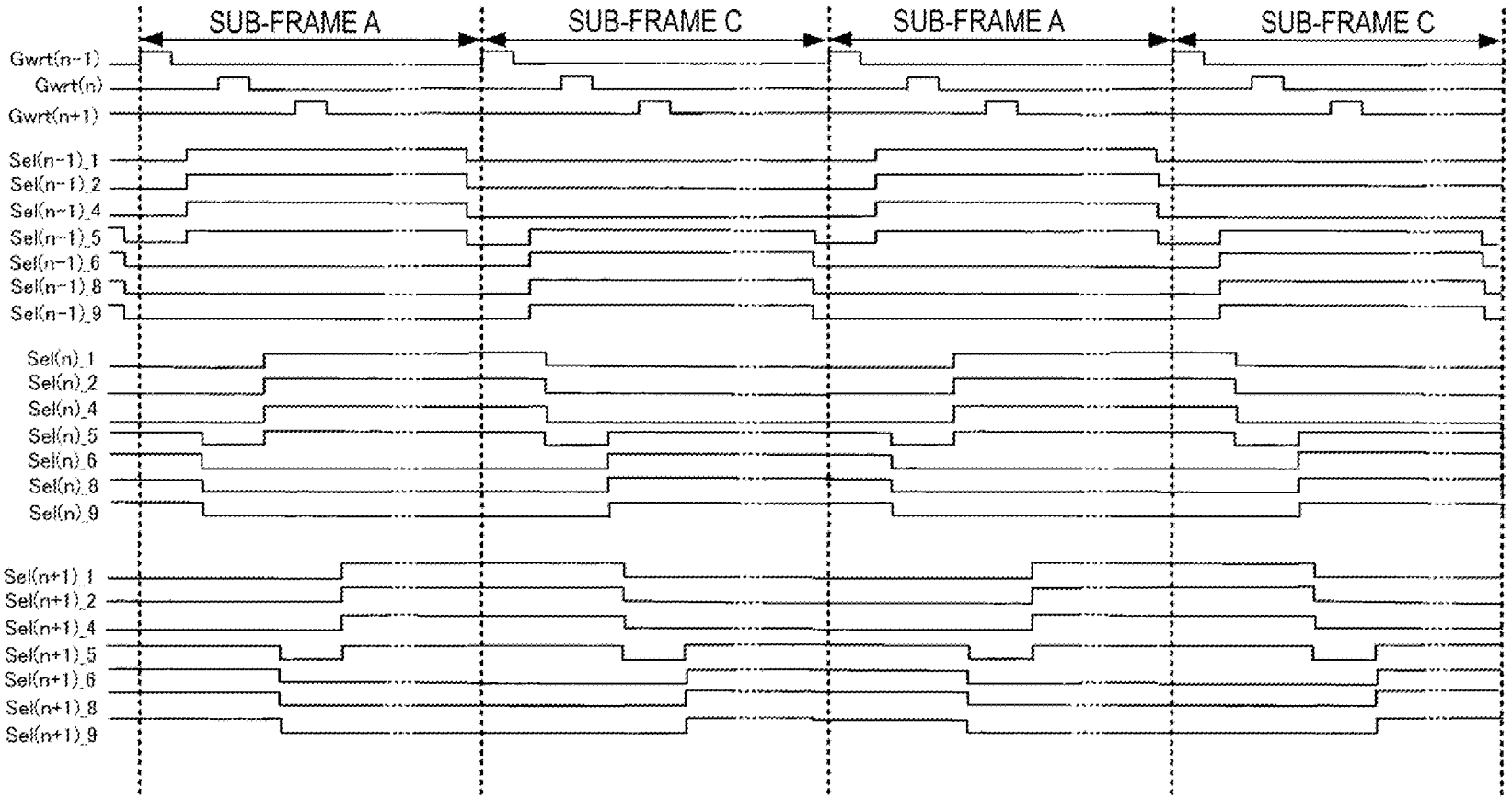
FIG. 25 is a diagram illustrating operation in a display region.

FIG. 25 is a diagram used to explain operation concerning three continuous rows of the (n−1)-th row, the n-th row, and the (n+1)-th row. As compared with the second embodiment, the third embodiment does not include the transistors Sw3 and Sw7, and does not need the control signals Sel(1)_3 to Sel(q)_3 or the control signals Sel(1)_7 to Sel(q)_7. The sub-frame A and the sub-frame C are alternately repeated in one frame. Thus, FIG. 15 in the third embodiment is illustrated as FIG. 25 in the second embodiment.

Figure 26:
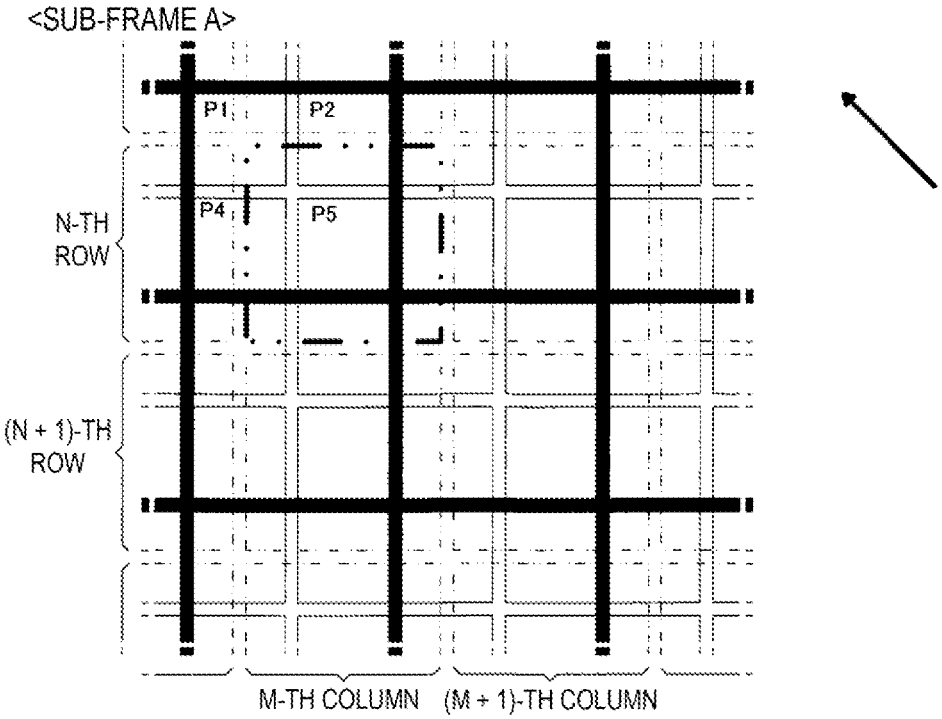
FIG. 26 is a diagram illustrating shift of panel pixels in a display region.
Figure 27:
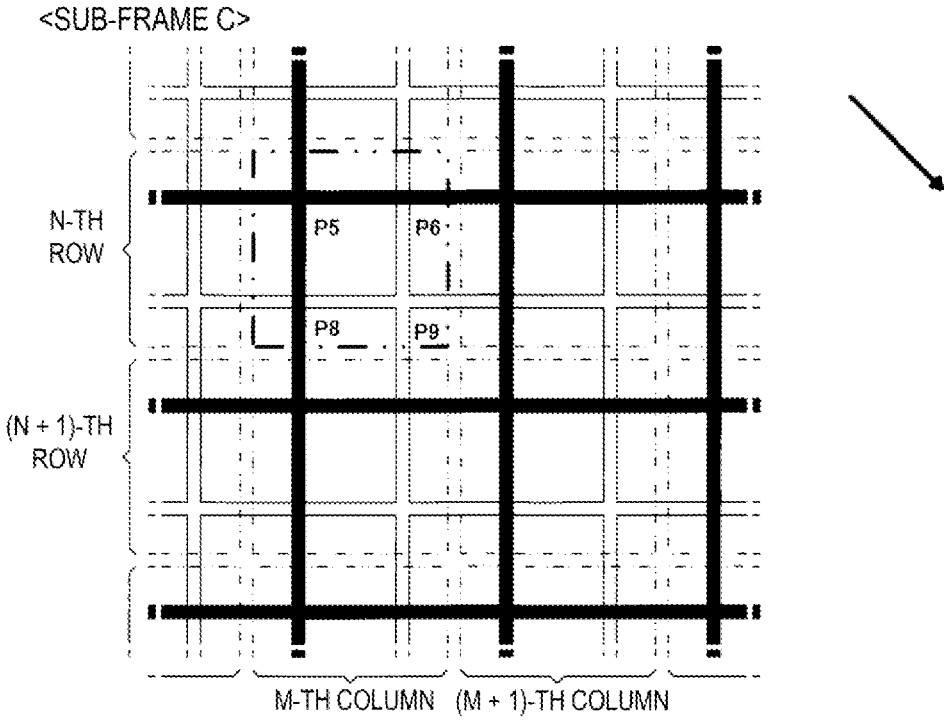
FIG. 27 is a diagram illustrating shift of panel pixels in a display region.

FIG. 26 is a diagram illustrating an example of display of the display device 10 according to the third embodiment in the sub-frame A. In the sub-frame A, a current corresponding to a potential of the data signal Data(m) is supplied to the pixel electrodes P1, P2, P4, and P5 from the viewpoint of the pixel circuit 16 at the n-th row and m-th column. This causes the light emitting elements 18 corresponding to the respective pixel electrodes P1, P2, P4, and P5 to emit light having luminance corresponding to this current. FIG. 27 is a diagram illustrating an example of display in the sub-frame C. In the sub-frame C, the light emitting elements 18 corresponding to the respective pixel electrodes P5, P6, P8, and P9 corresponding to the pixel circuit 16 at the n-th row and m-th column emit light having luminance corresponding to this current.

With the third embodiment, since four panel pixels used to perform display in the sub-frame A and the sub-frame C are shifted in one axis angled at 45 degrees, it is possible to display an image designated by the image data Vin supplied from a higher level device while artificially increasing the resolution of the display device 10. In addition, in the present embodiment, in any of the sub-frame A and the sub-frame C, all the light emitting elements 18 are also selected by any of the selectors to emit light, which makes it possible to achieve the increased luminance. In other words, with the present embodiment, it is possible to achieve the increased luminance and improve the feeling of resolution while avoiding an increase in the number of transistors, as compared with a mode in which a pixel circuit 16 is provided corresponding to a light emitting element on a one-to-one basis. In addition, in a case of the present embodiment, panel pixels are shifted at the time when data signals are supplied to pixel electrodes, which, in principle, avoids occurrence of the inconvenience in which the state of shifting is visually recognized differently from row to row.

4. Modification Examples

Each of the embodiments described above may be modified in the following manner.

Figure 28:
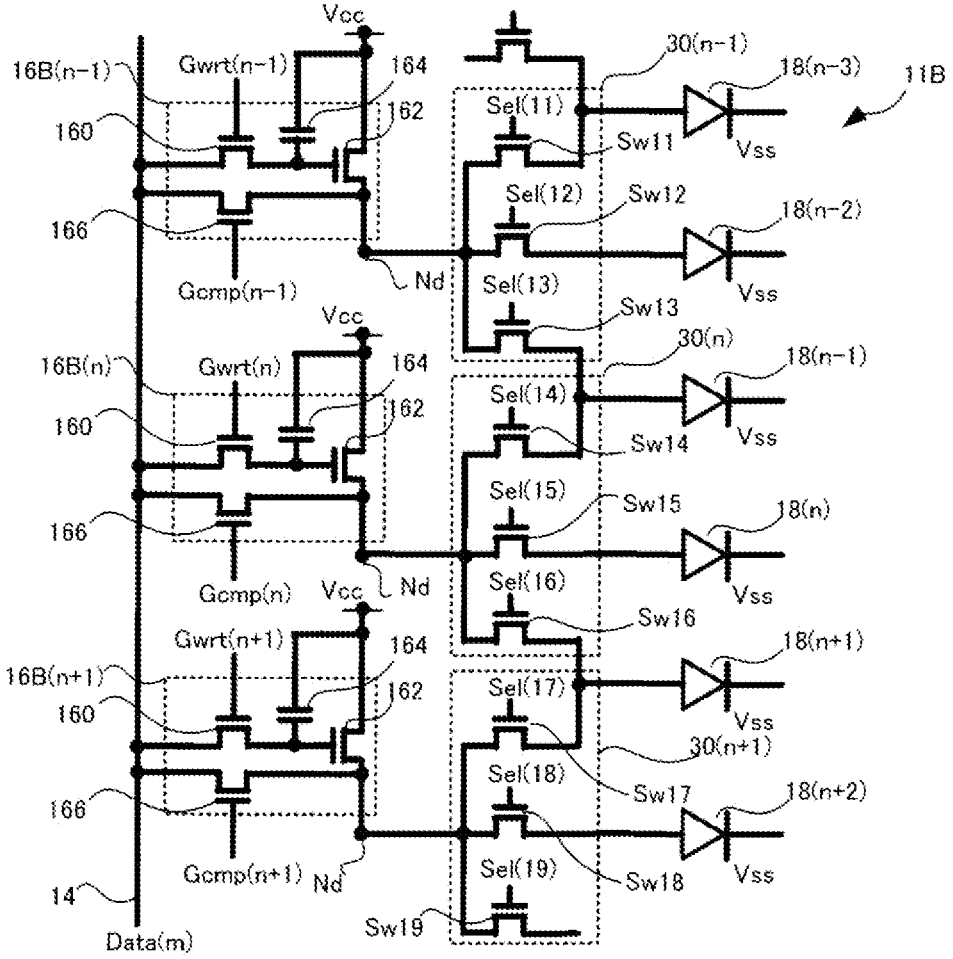
FIG. 28 is a block diagram illustrating an example of an electrical configuration of a display device according to a first modification example.

(1) The display device 11A according to the first embodiment may be configured in a manner similar to a display device 11B according to a first modification example illustrated in FIG. 28. FIG. 28 also illustrates only a portion concerning pixel circuits in the (n−1)-th row, the n-th row, and the (n+1)-th row and in the m-th column from among q×p pieces of pixel circuits arrayed in the q rows and p columns as in FIG. 6. In FIG. 28, the same reference characters are attached to the same constituent elements as those in FIG. 6. As can be clearly understood from the comparison between FIG. 28 and FIG. 6, the configuration of the display device 11B differs from the configuration of the display device 11A in that a pixel circuit 16B(n−1), a pixel circuit 16B(n), and a pixel circuit 16B(n+1) are provided in place of the pixel circuit 16($n$−1), the pixel circuit 16($n$), and the pixel circuit 16($n$+1), respectively. In the following description, the pixel circuit 16B(n−1), the pixel circuit 16B(n), and the pixel circuit 16B(n+1) are referred to as a pixel circuit 16B unless they need to be distinguished.

The configuration of the pixel circuit 16B differs from the configuration of the pixel circuit 16 in that the pixel circuit includes a transistor 166 to be used at the time of compensating a threshold voltage of the transistor 162. The transistor 166 is used only to compensate the threshold voltage of the transistor 162, and stays in the off state at the time of displaying an image. Thus, the operation of the display device 11B concerning displaying an image is the same as the operation of the display device 11A. In other words, even with the display device 11B, it is possible to improve the feeling of resolution and achieve the increased luminance while suppressing an increase in the number of transistors, as compared with a mode in which a pixel circuit is provided corresponding to a light emitting element on a one-to-one basis. Note that the transistor 166 may be used to reset the light emitting element 18, rather than compensation for the threshold voltage of the transistor 162. Note that the pixel circuit 16 according to the second and third embodiments may be replaced with the pixel circuit 16B according to the first modification example.

Figure 29:
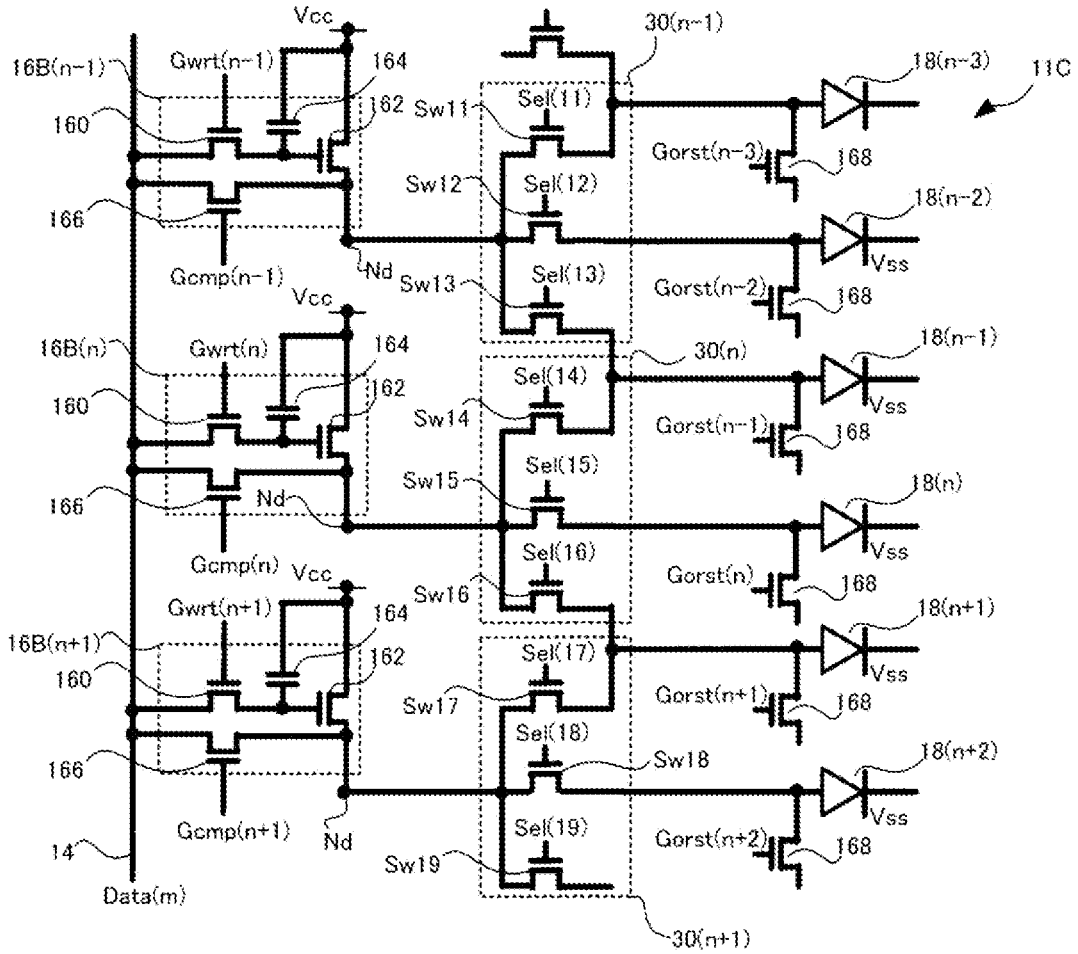
FIG. 29 is a block diagram illustrating an example of an electrical configuration of a display device according to a second modification example.

(2) The display device 11A according to the first embodiment may be configured in a manner similar to the configuration of a display device 11C according to a second modification example illustrated in FIG. 29. FIG. 29 illustrates only a portion concerning pixel circuits in the (n−1)-th row, the n-th row, and the (n+1)-th row and in the m-th column from among q×p pieces of pixel circuits arrayed in the q rows and p columns as in FIG. 28. In FIG. 29, the same reference characters are attached to the same constituent elements as those in FIG. 28. As can be clearly understood from the comparison between FIG. 29 and FIG. 28, the configuration of the display device 11C and the configuration of the display device 11B differ in that the transistor 166 used to reset the light emitting element 18 is provided corresponding to each light emitting element. Even with the display device 11C, it is possible to improve the feeling of resolution and achieve the increased luminance while suppressing an increase in the number of transistors, as compared with a mode in which a pixel circuit is provided corresponding to a light emitting element on a one-to-one basis. Note that, for the display device 10 according to the second and third embodiments, the transistor 166 used to reset the light emitting element 18 may be similarly provided corresponding to each light emitting element 18.

Figure 30:
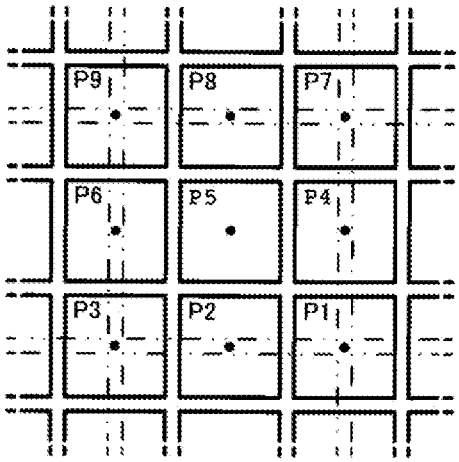
FIG. 30 is a diagram illustrating an array of pixel electrodes according to a third modification example.

(3) In the third embodiment, the sub-frame A is set as the start of one frame at the time of using the sub-frame A and the sub-frame C. However, the sub-frame C may be set as the start of one frame. In a case of a third modification example in which the sub-frame C is set as the start of one frame, it is only necessary to attach reference characters to pixel electrodes corresponding to the pixel circuit 16 at the n-th row and m-th column in a manner illustrated in FIG. 30. Thus, when the sub-frame C is set as the start of one frame, the data signal Data(m) is supplied in the starting sub-frame to the pixel electrodes P1, P2, P4, and P5 for the pixel circuit 16 at the n-th row and m-th column, and a data signal differing from the data signal Data(m) is supplied to the pixel electrodes P7 and P8, which is similar to the case where the sub-frame A is set as the start of one frame.

Figure 31:
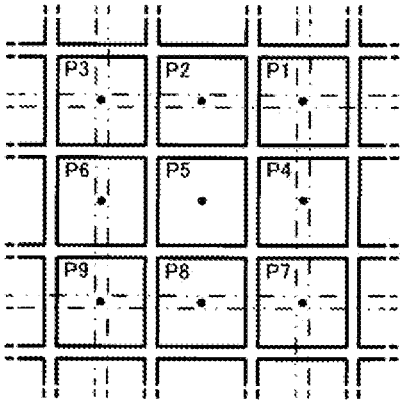
FIG. 31 is a diagram illustrating an array of pixel electrodes according to a fourth modification example.

Furthermore, the sub-frame B and the sub-frame D may be used. That is, the direction of the one axis angled at 45 degrees may be set at a position where the direction of shifting in FIGS. 26 and 27 is rotated by 90 degrees in a clockwise direction or a counterclockwise direction. Note that, in a case of a fourth modification example in which the sub-frame B is set as the start of one frame when the sub-frame B and the sub-frame D are used, it is only necessary to attach reference characters to pixel electrodes corresponding to the pixel circuit 16 at the n-th row and m-th column in a manner illustrated in FIG. 31.

Figure 32:
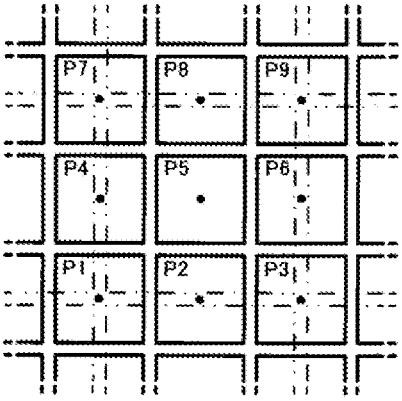
FIG. 32 is a diagram illustrating an array of pixel electrodes according to a fifth modification example.

In addition, in a case of a fifth modification example in which the sub-frame D is set as the start of one frame when the sub-frame B and the sub-frame D are used, it is only necessary to attach reference characters to pixel electrodes corresponding to the pixel circuit 16 at the n-th row and m-th column in a manner illustrated in FIG. 32. In any of the cases, the data signal Data(m) is supplied in the starting sub-frame to the pixel electrodes P1, P2, P4, and P5 for the pixel circuit 16 at the n-th row and m-th column, and a data signal differing from the data signal Data(m) is supplied to the pixel electrodes P7 and P8, which is similar to the case where the sub-frame A is set as the start of one frame.

(4) The second embodiment describes an example of application of two-axis shifting to single color panels. The third embodiment describes an example of application of one-axis shifting to single color panels. However, the one-axis shifting may be applied to an RGB panel. In addition, the two-axis shifting may be applied to an RGB panel.

Figure 33:
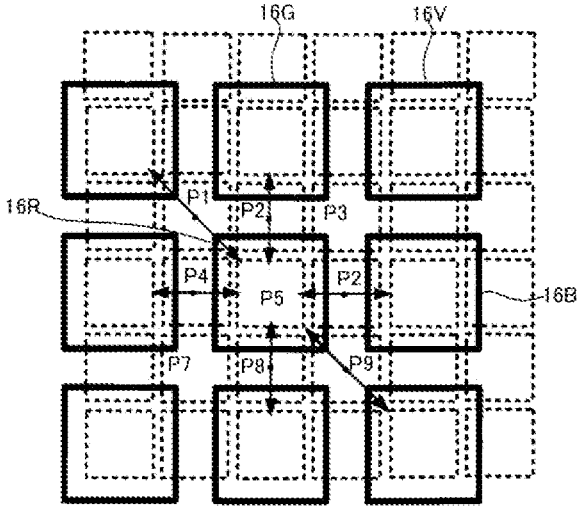
FIG. 33 is a diagram illustrating a connection between a pixel circuit and pixel electrodes according to a sixth modification example.

FIG. 33 is a diagram illustrating one example of a relationship of connection between a pixel circuit 16 and pixel electrodes in a display device according to a sixth modification example in which one-axis shifting is applied to an RGB panel. In FIG. 33, the square box with a dotted line indicates a pixel electrode, and the square box with a solid line indicates a pixel circuit. The pixel circuits 16R, 16G, 16B, and 16V in FIG. 33 each output a data signal indicating red, green, blue, and purple, respectively. As illustrated in FIG. 33, the pixel circuits 16R, 16G, 16B, and 16V are arrayed in a matrix manner of 2×2. The top end of the arrow in FIG. 33 corresponds to the coupling point on the pixel circuit 16 side, and the black dot corresponds to the coupling point to the pixel electrode side. Although the connection relationship concerning the pixel electrode P5 is not illustrated in FIG. 33, the pixel electrode P5 is coupled only to the pixel circuit 16R located directly below the pixel electrode P5, as is the case in the third embodiment.

In the sixth modification example illustrated in FIG. 33, the pixel circuits 16R, 16G, 16B, and 16V are each coupled to seven pixel electrodes as in the third embodiment. As in the third embodiment, the pixel electrodes P1 to P4 and P6 to P9 are classified into pixel electrodes coupled to two pixel circuits and pixel electrodes coupled to four pixel circuits. With the display device in which the pixel circuit 16 and pixel electrodes are coupled to each other as illustrated in FIG. 33, by performing the operation illustrated in FIG. 25, it is possible to achieve the one-axis shifting illustrated in FIG. 34, as in the third embodiment.

Figure 35:
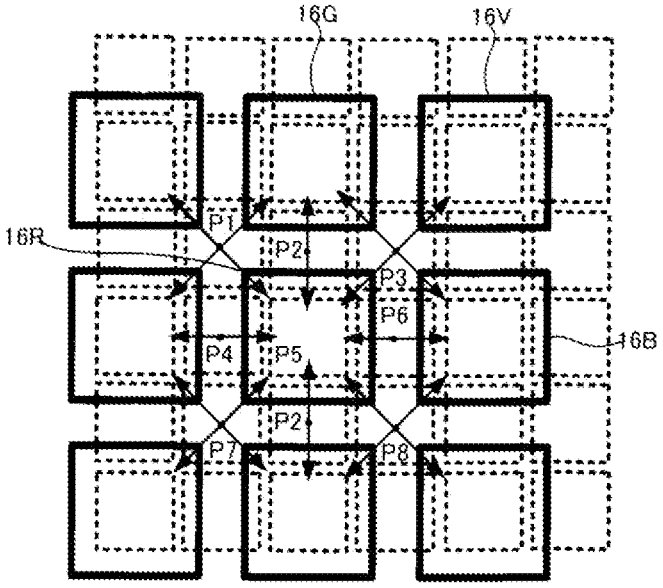
FIG. 35 is a diagram illustrating a connection between a pixel circuit and pixel electrodes according to a seventh modification example.
Figure 36:
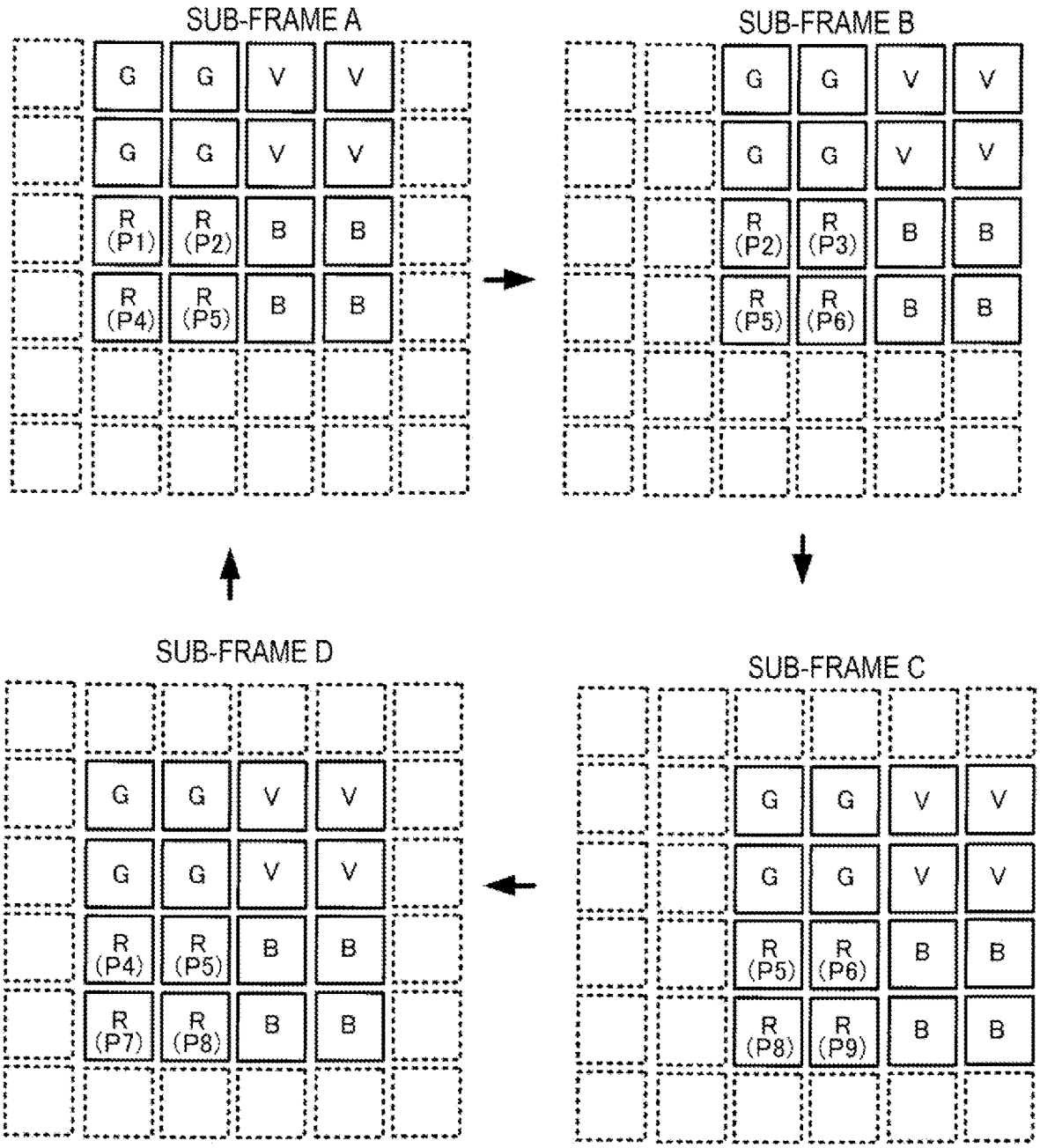
FIG. 36 is a diagram illustrating operation of a display device according to the seventh modification example.

Furthermore, with a display device according to a seventh modification example in which pixel electrodes are coupled to each of the pixel circuits 16R, 16G, 16B, and 16V as illustrated in FIG. 35, by performing the operation illustrated in FIG. 15, it is possible to achieve two-axis shifting as illustrated in FIG. 36. Note that the shapes of the pixel electrodes and the pixel circuit 16 are not limited to a square shape, and may be a rectangular shape.

Figure 37:
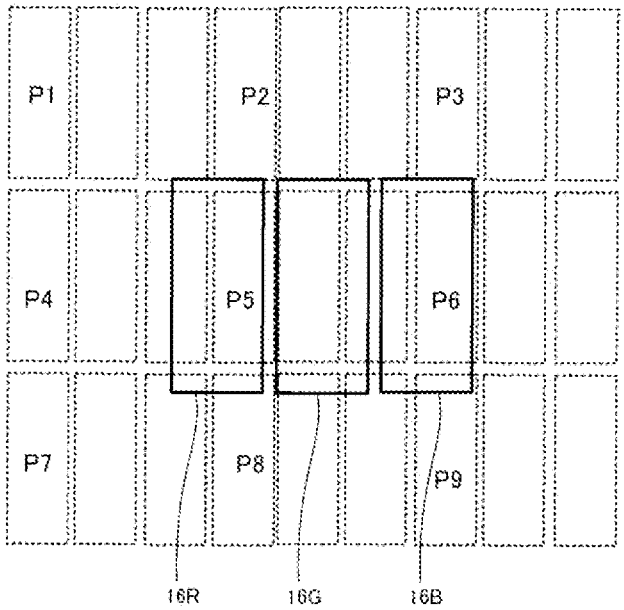
FIG. 37 is a diagram illustrating operation of a display device according to an eighth modification example.

In addition, it is not essential that the pixel electrodes P1 to P9 from the viewpoint of each of the pixel circuits 16R, 16G, and 16B are adjacent to each other in the X direction. For example, other pixel electrodes may be disposed between the pixel electrode P1 and the pixel electrode P2 from the viewpoint of the pixel circuit 16R, as in an eighth modification example illustrated in FIG. 37. In FIG. 37, the square box with a dotted line indicates a pixel electrode, and the square box with a solid line indicates a pixel circuit, as is the case in FIG. 33.

Although detailed illustration is not given in FIG. 37, on the right side of the pixel electrode P1, there is disposed a pixel electrode P1 from the viewpoint of the pixel circuit 16G. In addition, a pixel electrode P1 from the viewpoint of the pixel circuit 16B is located directly on the right side of the pixel electrode P1 from the viewpoint of the pixel circuit 16G.

Similarly, on the right side of the pixel electrode P2, there is disposed a pixel electrode P2 from the viewpoint of the pixel circuit 16G. In addition, a pixel electrode P2 from the viewpoint of the pixel circuit 16B is located directly on the right side of the pixel electrode P2 from the viewpoint of the pixel circuit 16G.

On the right side of the pixel electrode P3, there is disposed a pixel electrode P3 from the viewpoint of the pixel circuit 16G. In addition, a pixel electrode P3 from the viewpoint of the pixel circuit 16B is located directly on the right side of the pixel electrode P3 from the viewpoint of the pixel circuit 16G.

On the right side of the pixel electrode P4, there is disposed a pixel electrode P4 from the viewpoint of the pixel circuit 16G. In addition, a pixel electrode P4 from the viewpoint of the pixel circuit 16B is located directly on the right side of the pixel electrode P4 from the viewpoint of the pixel circuit 16G.

On the right side of the pixel electrode P5, there is disposed a pixel electrode P5 from the viewpoint of the pixel circuit 16G. In addition, a pixel electrode P5 from the viewpoint of the pixel circuit 16B is located directly on the right side of the pixel electrode P5 from the viewpoint of the pixel circuit 16G.

On the right side of the pixel electrode P6, there is disposed a pixel electrode P6 from the viewpoint of the pixel circuit 16G. In addition, a pixel electrode P6 from the viewpoint of the pixel circuit 16B is located directly on the right side of the pixel electrode P6 from the viewpoint of the pixel circuit 16G.

On the right side of the pixel electrode P7, there is disposed a pixel electrode P7 from the viewpoint of the pixel circuit 16G. In addition, a pixel electrode P7 from the viewpoint of the pixel circuit 16B is located directly on the right side of the pixel electrode P7 from the viewpoint of the pixel circuit 16G.

On the right side of the pixel electrode P8, there is disposed a pixel electrode P8 from the viewpoint of the pixel circuit 16G. In addition, a pixel electrode P8 from the viewpoint of the pixel circuit 16B is located directly on the right side of the pixel electrode P8 from the viewpoint of the pixel circuit 16G.

On the right side of the pixel electrode P9, there is disposed a pixel electrode P9 from the viewpoint of the pixel circuit 16G. In addition, a pixel electrode P9 from the viewpoint of the pixel circuit 16B is located directly on the right side of the pixel electrode P9 from the viewpoint of the pixel circuit 16G.

Figure 34:
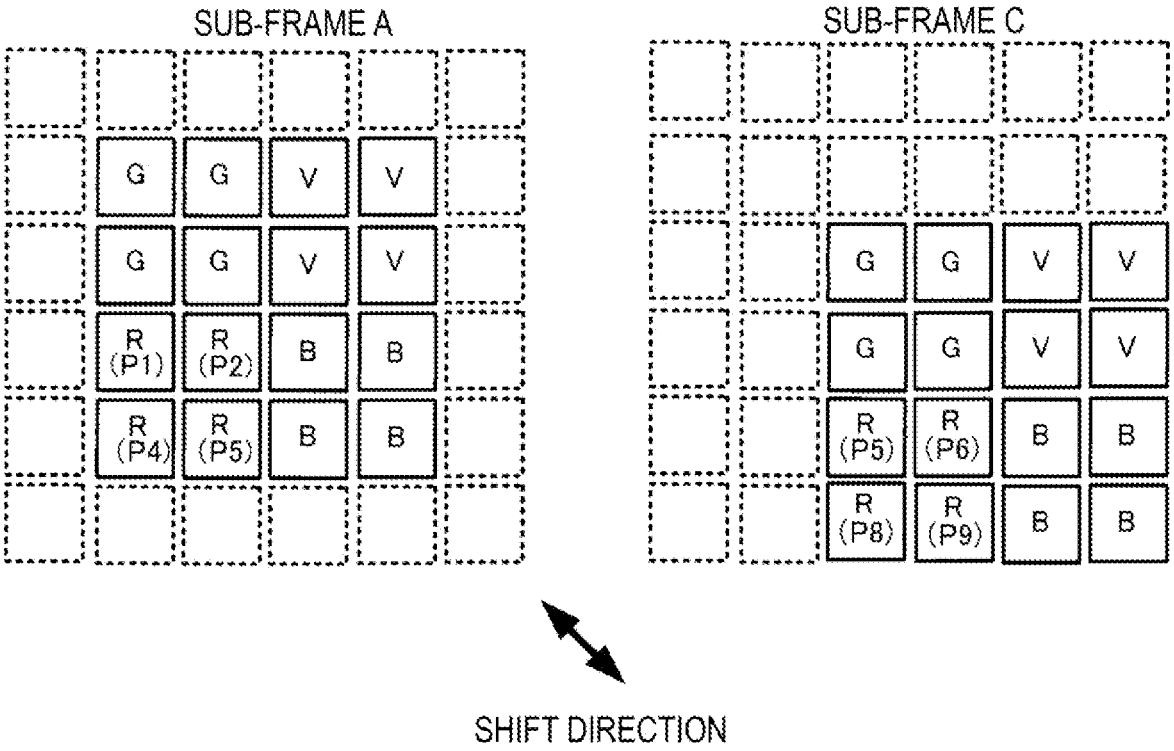
FIG. 34 is a diagram illustrating operation of a display device according to the sixth modification example.
Figure 38:
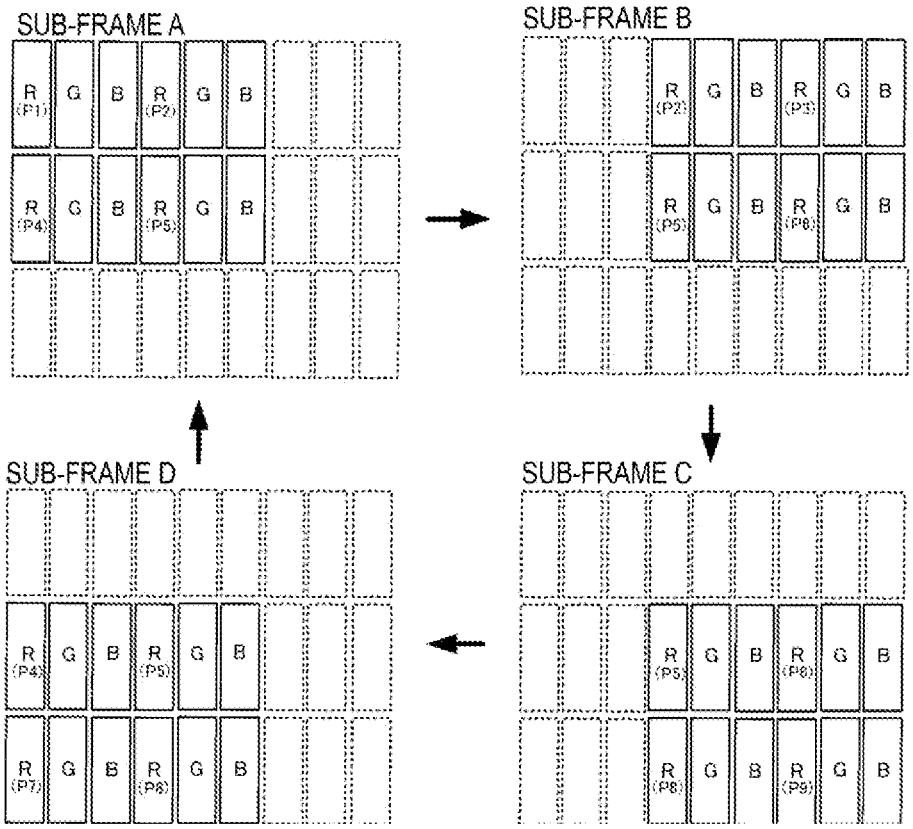
FIG. 38 is a diagram illustrating operation of the display device according to the eighth modification example.

With the display device in which pixel electrodes and a pixel circuit are disposed as illustrated in FIG. 37, it is possible to achieve two-axis shifting as illustrated in FIG. 38 by coupling a pixel circuit and pixel electrodes P1 to P9 from the viewpoint of this pixel circuit to each other as illustrated in FIG. 34, and performing the operation illustrated in FIG. 15.

(5) It may be possible to apply the vertical-axis sharing in the first embodiment to single color panels. In addition, although the light emitting element 18 according to each of the embodiments is an OLED, it may be possible to use other self light emitting elements such as μLED as the light emitting element 18. Furthermore, it may be possible to apply the present disclosure to a reflective or transmissive display device using liquid crystal. Furthermore, each of the embodiments described above describes an example of application of the present disclosure to a projector. However, the present disclosure can be applied to any electronic device having a display device such as a head-mounted display (HMD), a smartphone, a tablet terminal, or a notebook personal computer.

5. Aspects Identified from at Least One of the Embodiments and the Individual Modification Examples The present disclosure is not limited to the embodiments and the modification examples described above, and can be achieved in various aspects without departing from the main points of the present disclosure. For example, the present disclosure can be achieved in the following aspects. Technical features in the embodiments described above corresponding to technical features in each aspect described below can be replaced or combined as appropriate in order to solve part of or all of the problems of the present disclosure or in order to achieve part of or all of the effects of the present disclosure. Furthermore, when the technical feature is not described in the present description as an essential feature, it is possible to delete it as appropriate.

One aspect of the display device according to the present disclosure includes a data line, a first pixel circuit, a second pixel circuit, first to ninth light emitting elements, a first selector, and a second selector. The first pixel circuit and the second pixel circuit are provided corresponding to the data line. The first to ninth light emitting elements are arrayed in a matrix manner with the first light emitting element being the center. The first selector is configured to select at least any of the first light emitting element, the second light emitting element, and the third light emitting element, and supply the selected light emitting element by the first selector with a current corresponding to a potential supplied to the first pixel circuit. The second selector is configured to supply the selected light emitting element by the second selector with a current corresponding to a potential supplied to the second pixel circuit. In a case of the display device according to the present disclosure, in one sub-frame, the first selector selects the first light emitting element and the third light emitting element, and the second selector selects the second light emitting element. In a sub-frame differing from the one sub-frame, the first selector selects the first light emitting element and the second light emitting element. With the display device according to the present aspect, in any of the one sub-frame and the sub-frame differing from the one sub-frame, it is possible to cause the first light emitting element and the second light emitting element to emit light. Thus, it is possible to achieve the display device having the increased luminance. Although details will be described later, with the display device according to the present aspect, it is possible to achieve an improvement of the feeling of resolution using vertical-axis sharing, one-axis shifting, two-axis shifting, or the like, without increasing the number of transistors, as compared with a case in which a pixel circuit is provided corresponding to a light emitting element on a one-to-one basis.

The display device according to a more preferred aspect may include a tenth light emitting element and an eleventh light emitting element that are arrayed along the data line and above the second light emitting element. In the display device according to the present aspect, the second selectors can select at least any of the tenth light emitting element and the eleventh light emitting element. In the one sub-frame, the first selector selects the second light emitting element and the tenth light emitting element. In the sub-frame differing from the one sub-frame, the second selector selects the tenth light emitting element and the eleventh light emitting element. With the display device according to the present aspect, it is possible to achieve an improvement of the feeling of resolution. In addition, with the display device according to the present aspect, the first light emitting element, the second light emitting element, and the tenth light emitting element emit light in the one sub-frame and the sub-frame differing from the one sub-frame, and hence, it is possible to achieve the increased luminance.

In the display device according to a further preferred aspect, the first selector may include a first transistor, a second transistor, and a third transistor described below. In addition, the second selector may include a ninth transistor, a tenth transistor, and an eleventh transistor described below. The first transistor electrically couples the first pixel circuit and the first light emitting element. The second transistor electrically couples the first pixel circuit and the second light emitting element. The third transistor electrically couples the first pixel circuit and the third light emitting element. The ninth transistor electrically couples the second pixel circuit and the second light emitting element. The tenth transistor electrically couples the second pixel circuit and the tenth light emitting element. The eleventh transistor electrically couples the second pixel circuit and the eleventh light emitting element.

In the display device according to another preferred aspect, the first selector selects any of at least the first light emitting element, the second light emitting element, the third light emitting element, the fifth light emitting element, the sixth light emitting element, the seventh light emitting element, and the eighth light emitting element. The second selector selects at least any of the second light emitting element and the ninth light emitting element. In the display device according to the present aspect, in the one sub-frame, the first selector selects the first light emitting element, the third light emitting element, the seventh light emitting element, and the eighth light emitting element. In this one sub-frame, the second selector selects at least the second light emitting element and the ninth light emitting element. In addition, in the sub-frame differing from the one sub-frame, the first selector selects the first light emitting element, the second light emitting element, the fifth light emitting element, and the sixth light emitting element. With the display device according to the present aspect having such a configuration, it is possible to achieve an improvement of the feeling of resolution using one-axis shifting or two-axis shifting.

In the display device according to another preferred aspect, the one sub-frame and the sub-frame differing from the one sub-frame may occur alternately. With the present aspect, it is possible to achieve an improvement of the feeling of resolution using one-axis shifting. In the display device according to a more preferred aspect, the first selector may include first to third transistors, and fifth to eighth transistors described below. The first transistor electrically couples the first pixel circuit and the first light emitting element. The second transistor electrically couples the first pixel circuit and the second light emitting element. The third transistor electrically couples the first pixel circuit and the third light emitting element. The fifth transistor electrically couples the first pixel circuit and the fifth light emitting element. The sixth transistor electrically couples the first pixel circuit and the sixth light emitting element. The seventh transistor electrically couples the first pixel circuit and the seventh light emitting element. The eighth transistor electrically couples the first pixel circuit and the eighth light emitting element. In addition, the second sector may include the following twelfth and thirteenth transistors. The twelfth transistor electrically couples the second pixel circuit and the second light emitting element. The thirteenth transistor electrically couples the second pixel circuit and the ninth light emitting element.

The display device according to a further preferred aspect may be configured such that the first selector can also select the fourth light emitting element and the ninth light emitting element, and the second selector can also select the sixth light emitting element. In the display device according to a further preferred aspect, the one sub-frame is a first sub-frame, and the sub-frame differing from the one sub-frame is a third sub-frame. In the display device according to the present aspect, in a second sub-frame subsequent to the first sub-frame, the first selector selects the first light emitting element, the third light emitting element, the fourth light emitting element, and the fifth light emitting element, and the second selector selects the second light emitting element and the sixth light emitting element. In a fourth sub-frame subsequent to the third sub-frame, the first selector selects the first light emitting element, the second light emitting element, the eighth light emitting element, and the ninth light emitting element. With the display device according to the present aspect, it is possible to achieve an improvement of the feeling of resolution using two-axis shifting.

In the display device according to a further preferred aspect, the first selector may include the following first to ninth transistors. The first transistor electrically couples the first pixel circuit and the first light emitting element. The second transistor electrically couples the first pixel circuit and the second light emitting element. The third transistor electrically couples the first pixel circuit and the third light emitting element. The fourth transistor electrically connects the first pixel circuit and the fourth light emitting element. The fifth transistor electrically couples the first pixel circuit and the fifth light emitting element. The sixth transistor electrically couples the first pixel circuit and the sixth light emitting element. The seventh transistor electrically couples the first pixel circuit and the seventh light emitting element. The eighth transistor electrically couples the first pixel circuit and the eighth light emitting element. The ninth transistor electrically connects the first pixel circuit and the ninth light emitting element. The second selector may include the following twelfth to fourteenth transistors. The twelfth transistor electrically couples the second pixel circuit and the second light emitting element. The thirteenth transistor electrically couples the second pixel circuit and the ninth light emitting element. The fourteenth transistor electrically connects the second pixel circuit and the sixth light emitting element.

One aspect of an electronic device according to the present disclosure includes the display device according to any one of the aspects described above. With the electronic device according to the present aspect, in any of the one sub-frame and the sub-frame differing from the one sub-frame, it is possible to cause the first light emitting element and the second light emitting element to emit light. Thus, it is possible to achieve the increased luminance of display. In addition, with the electronic device according to the present aspect, it is possible to achieve an improvement of the feeling of resolution using vertical-axis sharing, one-axis shifting, two-axis shifting, or the like, without increasing the number of transistors, as compared with a case in which a pixel circuit is provided corresponding to a light emitting element on a one-to-one basis.

What is claimed is:

1. A display device comprising:

a data line;

a first pixel circuit provided corresponding to the data line;

a second pixel circuit provided corresponding to the data line;

first to ninth light emitting elements arrayed in a matrix manner with the first light emitting element being a center;

a first selector configured to select at least any of the first light emitting element, the second light emitting element, and the third light emitting element, and supply the selected light emitting element by the first selector with a current corresponding to a potential supplied to the first pixel circuit; and a second selector that is capable of selecting at least the second light emitting element and is configured to supply the selected light emitting element by the second selector with a current corresponding to a potential supplied to the second pixel circuit, wherein, in one sub-frame, the first selector selects the first light emitting element and the third light emitting element, and the second selector selects the second light emitting element, and in a sub-frame differing from the one sub-frame, the first selector selects the first light emitting element and the second light emitting element.

2. The display device according to claim 1, comprising:

a tenth light emitting element and an eleventh light emitting element that are arrayed along the data line and above the second light emitting element, wherein the second selector selects at least any of the second light emitting element, the tenth light emitting element, and the eleventh light emitting element, in the one sub-frame, the second selector selects the second light emitting element and the tenth light emitting element, and in the sub-frame differing from the one sub-frame, the second selector selects the tenth light emitting element and the eleventh light emitting element.

3. The display device according to claim 2, wherein the first selector includes:

a first transistor that electrically couples the first pixel circuit and the first light emitting element;

a second transistor that electrically couples the first pixel circuit and the second light emitting element; and a third transistor that electrically couples the first pixel circuit and the third light emitting element, and the second selector includes:

a tenth transistor that electrically couples the second pixel circuit and the tenth light emitting element;

an eleventh transistor that electrically couples the second pixel circuit and the eleventh light emitting element; and a twelfth transistor that electrically couples the second pixel circuit and the second light emitting element.

4. The display device according to claim 1, wherein the first selector selects at least any of the first light emitting element, the second light emitting element, the third light emitting element, the fifth light emitting element, the sixth light emitting element, the seventh light emitting element, and the eighth light emitting element, the second selector selects at least any of the second light emitting element and the ninth light emitting element, in the one sub-frame, the first selector selects the first light emitting element, the third light emitting element, the seventh light emitting element, and the eighth light emitting element, and the second selector selects at least the second light emitting element and the ninth light emitting element, and in the sub-frame differing from the one sub-frame, the first selector selects the first light emitting element, the second light emitting element, the fifth light emitting element, and the sixth light emitting element.

5. The display device according to claim 4, wherein the one sub-frame and the sub-frame differing from the one sub-frame occur alternately.

6. The display device according to claim 5, wherein the first selector includes:

a first transistor that electrically couples the first pixel circuit and the first light emitting element;

a second transistor that electrically couples the first pixel circuit and the second light emitting element;

a third transistor that electrically couples the first pixel circuit and the third light emitting element;

a fifth transistor that electrically couples the first pixel circuit and the fifth light emitting element;

a sixth transistor that electrically couples the first pixel circuit and the sixth light emitting element;

a seventh transistor that electrically couples the first pixel circuit and the seventh light emitting element; and an eighth transistor that electrically couples the first pixel circuit and the eighth light emitting element, and the second selector includes:

a twelfth transistor that electrically couples the second pixel circuit and the second light emitting element; and a thirteenth transistor that electrically couples the second pixel circuit and the ninth light emitting element.

7. The display device according to claim 6, wherein the first selector includes:

a first transistor that electrically couples the first pixel circuit and the first light emitting element;

a second transistor that electrically couples the first pixel circuit and the second light emitting element;

a third transistor that electrically couples the first pixel circuit and the third light emitting element;

a fourth transistor that electrically couples the first pixel circuit and the fourth light emitting element;

a fifth transistor that electrically couples the first pixel circuit and the fifth light emitting element;

a sixth transistor that electrically couples the first pixel circuit and the sixth light emitting element;

a seventh transistor that electrically couples the first pixel circuit and the seventh light emitting element;

an eighth transistor that electrically couples the first pixel circuit and the eighth light emitting element; and a ninth transistor that electrically couples the first pixel circuit and the ninth light emitting element, and the second selector includes:

a twelfth transistor that electrically couples the second pixel circuit and the second light emitting element;

a thirteenth transistor that electrically couples the second pixel circuit and the ninth light emitting element; and a fourteenth transistor that electrically couples the second pixel circuit and the sixth light emitting element.

8. The display device according to claim 4, wherein the selector includes:

a first transistor that electrically couples the first pixel circuit and the first light emitting element;

a second transistor that electrically couples the first pixel circuit and the second light emitting element;

a third transistor that electrically couples the first pixel circuit and the third light emitting element;

a fifth transistor that electrically couples the first pixel circuit and the fifth light emitting element;

a sixth transistor that electrically couples the first pixel circuit and the sixth light emitting element;

a seventh transistor that electrically couples the first pixel circuit and the seventh light emitting element; and an eighth transistor that electrically couples the first pixel circuit and the eighth light emitting element, and the second selector includes:

a twelfth transistor that electrically couples the second pixel circuit and the second light emitting element; and a thirteenth transistor that electrically couples the second pixel circuit and the ninth light emitting element.

9. The display device according to claim 4, wherein the first selector selects any of the first light emitting element, the second light emitting element, the third light emitting element, the fourth light emitting element, the fifth light emitting element, the sixth light emitting element, the seventh light emitting element, the eighth light emitting element, and the ninth light emitting element, and the second selector selects any of the second light emitting element, the sixth light emitting element, and the ninth light emitting element.

10. The display device according to claim 9, wherein the one sub-frame is a first sub-frame, the sub-frame differing from the one sub-frame is a third sub-frame, in a second sub-frame subsequent to the first sub-frame, the first selector selects the first light emitting element, the third light emitting element, the fourth light emitting element, and the fifth light emitting element, and the second selector selects the second light emitting element and the sixth light emitting element, and in a fourth sub-frame subsequent to the third sub-frame, the first selector selects the first light emitting element, the second light emitting element, the eighth light emitting element, and the ninth light emitting element.

11. The display device according to claim 10, wherein the first selector includes:

a first transistor that electrically couples the first pixel circuit and the first light emitting element;

a second transistor that electrically couples the first pixel circuit and the second light emitting element;

a third transistor that electrically couples the first pixel circuit and the third light emitting element;

a fourth transistor that electrically couples the first pixel circuit and the fourth light emitting element;

a fifth transistor that electrically couples the first pixel circuit and the fifth light emitting element;

a sixth transistor that electrically couples the first pixel circuit and the sixth light emitting element;

a seventh transistor that electrically couples the first pixel circuit and the seventh light emitting element;

an eighth transistor that electrically couples the first pixel circuit and the eighth light emitting element; and a ninth transistor that electrically couples the first pixel circuit and the ninth light emitting element, and the second selector includes:

a twelfth transistor that electrically couples the second pixel circuit and the second light emitting element;

a thirteenth transistor that electrically couples the second pixel circuit and the ninth light emitting element; and a fourteenth transistor that electrically couples the second pixel circuit and the sixth light emitting element.

12. An electronic device comprising the display device according to claim 1.

* * * * *